US007096559B2

(12) United States Patent
Johnson

(10) Patent No.: US 7,096,559 B2
(45) Date of Patent: Aug. 29, 2006

(54) AUTOMATED TIGHTENING SHOE AND METHOD

(76) Inventor: Gregory G. Johnson, 2025 Gateway Cir., Suite 1, Centerville, MN (US) 55038

( * ) Notice: Subject to any disclaimer, the term of this patent is extended or adjusted under 35 U.S.C. 154(b) by 352 days.

(21) Appl. No.: 10/732,664

(22) Filed: Dec. 9, 2003

(65) Prior Publication Data

US 2006/0156584 A1 Jul. 20, 2006

Related U.S. Application Data

(60) Continuation-in-part of application No. 10/093,918, filed on Mar. 7, 2002, which is a division of application No. 09/675,607, filed on Sep. 29, 2000, now Pat. No. 6,467,194, which is a continuation-in-part of application No. 09/048,772, filed on Mar. 26, 1998, now abandoned.

(51) Int. Cl.
*B23P 19/04* (2006.01)
*A43C 11/00* (2006.01)

(52) U.S. Cl. ..... 29/433; 36/50.1

(58) Field of Classification Search ..... 29/433, 29/428, 235, 241; 36/50.1, 118.1, 50.5, 118.2; 24/712.7

See application file for complete search history.

(56) References Cited

U.S. PATENT DOCUMENTS

| | | | | |
|---|---|---|---|---|
| 5,983,530 | A * | 11/1999 | Chou | 36/50.1 |
| 6,427,361 | B1 * | 8/2002 | Chou | 36/50.1 |
| 6,691,433 | B1 * | 2/2004 | Liu | 36/50.1 |
| 6,694,643 | B1 * | 2/2004 | Hsu | 36/50.1 |

* cited by examiner

*Primary Examiner*—John C. Hong
(74) *Attorney, Agent, or Firm*—Drummond & Duckworth

(57) ABSTRACT

An automated tightening shoe where a tightening mechanism is actuated which operates in one direction to cause automatic tightening of the shoe about a wearer's foot and which releases to allow loosening of the shoe. Shoe laces are led to the interior of the tightening mechanism in the heel whereat the laces are operatively associated in a tightening or in a loosening direction with the tightening mechanism. The tightening mechanism includes a rotatable central shaft which may have drums mounted thereto, a ratcheted coupling collar or ratcheted cam disk, a ratcheted actuator spool, a compression spring, a return spring, a ratchet wheel, and a release lever including a pawl and a cam actuator bar, all of which extend along the central shaft and operate to tighten as well as to allow loosening of the shoe laces.

60 Claims, 17 Drawing Sheets

AUTOMATED TIGHTENING SHOE AND METHOD

CROSS REFERENCES TO RELATED APPLICATIONS

This patent application is a continuation-in-part of Ser. No. 10/093,918 entitled "Automated Tightening Shoe" filed on Mar. 7, 2002, pending, which is a divisional of Ser. No. 09/675,607 entitled "Automated Tightening Shoe" filed on Sep. 29, 2000, U.S. Pat. No. 6,467,194, which is a continuation-in-part of Ser. No. 09/048,772 entitled "Automated Tightening Shoe" filed Mar. 26, 1998, now abandoned, all by the same inventor.

BACKGROUND OF THE INVENTION

1. Field of the Invention

The present invention pertains to a shoe and, more particularly, to an automated tightening shoe. The shoe is provided with an automated tightening system including a tightening mechanism which operates in one direction to cause automatic tightening of the shoe about a wearer's foot, and which can be released easily so that the shoe can be readily removed from the wearer's foot. The invention is chiefly concerned with an automated tightening shoe of the sport or athletic shoe variety, but the principles of the invention are applicable to shoes of many other types and styles.

2. Description of the Prior Art

Shoes which incorporate an automated tightening system are known in the prior art. However, none of the automated tightening systems heretofore devised has been entirely successful or satisfactory. Major shortcomings of the automated tightening systems of the prior art are that they fail to tighten the shoe from both sides so that it conforms snugly to the wearer's foot, and that they lack any provision for quickly loosening the shoe when it is desired to remove the shoe from the wearer's foot. Aspects of prior art automated tightening systems contributing to their lack of success and satisfaction have been (1) complexity, in that they involve numerous parts; (2) the inclusion of expensive parts, such as small electric motors; (3) the use of parts needing periodic replacement, e.g., a battery; and (4) the presence of parts requiring frequent maintenance. These aspects, as well as others not specifically mentioned, indicate that considerable improvement is needed in order to attain an automated tightening shoe that is completely successful and satisfactory.

SUMMARY OF THE INVENTION

The general purpose of the present invention is to provide an automated tightening shoe that is devoid of the various shortcomings and drawbacks characteristic of shoes of this sort which exist in the prior art.

Accordingly, the primary objective of the present invention is to produce an automated tightening shoe, especially a sport or athletic shoe, that tightens snugly about the wearer's foot from both sides and that can be loosened easily. It is a further objective of the present invention to attain the primary objective by providing an automated tightening system which requires no complex or expensive parts, and which includes no parts that need frequent maintenance or periodic replacement. Another objective of the present invention is to provide an automated tightening shoe which is easy to operate and trouble-free in use.

The foregoing general purpose and objectives of the present invention are fully achieved by the automated tightening shoe of the present invention. As stated previously, the principles of the invention are applicable to shoes of many types and styles, but are especially applicable to shoes of the sport or athletic variety. Accordingly, it is this sort of shoe which has been selected for illustrating the principles of the invention.

The automated tightening shoe of the invention includes a sole and an integral body member or shoe upper constructed of any common sport or athletic shoe material or materials connected to the sole. The integral body member or shoe upper includes a toe, a heel, a tongue, a gap above the tongue, and a reinforced lacing pad aligned about the edge of the gap and aligned generally to the tongue, the reinforced lacing pad having a number of pairs of lace eyelets provided around the periphery of the gap. The shoe also includes a tightening mechanism in the heel. A pair of shoe laces, or alternatively a single length shoe lace, is provided for tightening the shoe at the gap. Each shoe lace has one external end anchored preferably to the region of the shoe upper at or near the junction of the tongue and the lower part of the gap by an anchoring fixture which can be a loop or other suitable device. The shoe laces extend through alternate lace eyelets in crisscross fashion over the tongue, and then pass through guide tubes which extend from the tightening mechanism through the material at the side of the shoe upper to within the tightening mechanism in the heel whereat the shoe laces are operatively associated in a tightening or in a loosening direction with the tightening mechanism.

The tightening mechanism includes an actuator cord which resides partly within a guide tube extending from the tightening mechanism through the fabric of the rear vertical portion of the heel and which has an actuator loop at one end. The actuator cord is movable in the guide tube in a tightening or in a loosening direction with the tightening mechanism.

The tightening mechanism includes a shaft located within a lower housing and an upper housing, or alternatively a one-piece housing, located in the heel upon which a ratcheted actuator spool including a plurality of ratchet teeth is slideably mounted and upon which a closely associated adjoining coupling collar with a plurality of ratchet teeth is mounted. The ratcheted actuator spool includes two disks, one of which is beveled and serves as a cam which is utilized during shoe lace tension release. A ratchet wheel having a coupling collar also mounts upon the shaft and is incorporated with a pawl to tighten the shoe laces. A compression spring and a return spring co-locate between the ratchet wheel and the ratcheted actuator spool.

A release lever, which protrudes from the rear of the heel, pivotally mounts to support panels extending from the upper and lower housings and includes a pawl which is engageable with the ratchet wheel and a cam actuator bar opposing the pawl.

The shoe laces, after entering the upper and lower housings of the tightening mechanism, are directed or coiled in the same direction about opposite ends of the shaft, and the actuator cord is coiled about and secured to the ratcheted actuator spool in a direction which is opposite to the direction in which the shoe laces are directed or coiled. The actuator cord has an end extending out of a passageway in the heel and, as previously mentioned, includes an actuator loop for grasping to move the actuator cord in the tightening direction. When the actuator cord is pulled by the actuator loop, the shoe laces further coil about the shaft or alternatively about a drum, thereby the shoe is tightened. The pawl successively engages the ratchet teeth of the ratchet wheel to prevent reverse movement.

Although all of the aspects and features of the automated tightening shoe enumerated above are important to the attainment of the purpose and objectives of the present invention and contribute to the overall superior quality, easy operation, and trouble-free performance of the shoe, certain ones are especially significant and merit special recognition.

One such significant aspect and feature of the present invention is the arrangement of crisscrossed shoe laces which effects tightening of the automated tightening shoe from both sides, thus producing a snug fit about the wearer's foot.

Another significant aspect and feature of the present invention is a tightening mechanism which includes a ratchet wheel mounted on a shaft, the ratchet wheel including ratchet teeth engageable by a pawl.

Still another such significant aspect and feature of the present invention is a ratchet wheel and pawl arrangement which allows movement of the shoe laces during tightening and which prevents reverse movement of the shoe laces after tightening is completed.

Yet another significant aspect and feature of the present invention is a ratcheted actuator spool slideably mounted along, over and about and being positionable along, over and about a rotatable shaft which can ratchetingly engage a ratcheted coupling collar mounted and secured over and about the rotatable shaft, whereby the rotatable shaft can be rotated in a suitable direction by rotation of the ratcheted actuator spool to tighten shoe laces.

Yet another significant aspect and feature of the present invention is a rotatable shaft the opposing ends of which or drums mounted thereto accommodate the securing of and the coiling of one end of separate shoe laces thereto, thereby providing the same shoe lace tensioning tension.

Still another significant aspect and feature of the present invention is a release lever having both a pawl and a cam actuator bar being incorporated singularly or together utilized to tighten and maintain tightness of the shoe laces or to release (loosen) the shoe laces.

Still another significant aspect and feature of the present invention is a simple to use release lever.

A still further such significant aspect and feature of the present invention is a ratcheted actuator spool and connected recoil or return spring incorporated for drawing the actuator cord back in the reverse direction after tightening is completed.

A still further significant aspect and feature of the present invention is a ratcheted actuator spool and connected recoil or return spring incorporated for maintaining the actuator cord in a coiled position after loosening is completed.

Yet another such significant aspect and feature of the present invention is a release lever for disengaging the ratcheted actuator spool to allow free reverse movement of the shoe laces to enable loosening of the shoe for removal from the wearer's foot.

Alternatively, another significant aspect and feature of the present invention is the use of drums having concave profile winding surfaces and the use of a ratcheted actuator spool being in close tolerance fit with upper and lower housings to prevent shoe lace jamming.

Alternatively, another significant aspect and feature of the present invention is a ratcheted actuator spool mounted along, over and about a rotatable shaft which can be ratchetingly engaged by a positionable ratcheted cam disk slideably mounted along, over and about and being positionable along the rotatable shaft.

Alternatively, another significant aspect and feature of the present invention is the use of a locating pin on a shaft to engage an elongated slot of a ratcheted cam disk to transfer power anywhere along the length of the elongated slot and locating pin engagement from the shaft to the ratcheted cam disk.

Alternatively, another significant aspect and feature of the present invention is a ratcheted actuator spool including a spring housing interacting with a return spring.

Alternatively, another significant aspect and feature of the present invention is a ratchet wheel having an attached drum.

Having thus described embodiments of the present invention and set forth significant aspects and features thereof, it is the principal object of the present invention to provide an automated tightening shoe.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
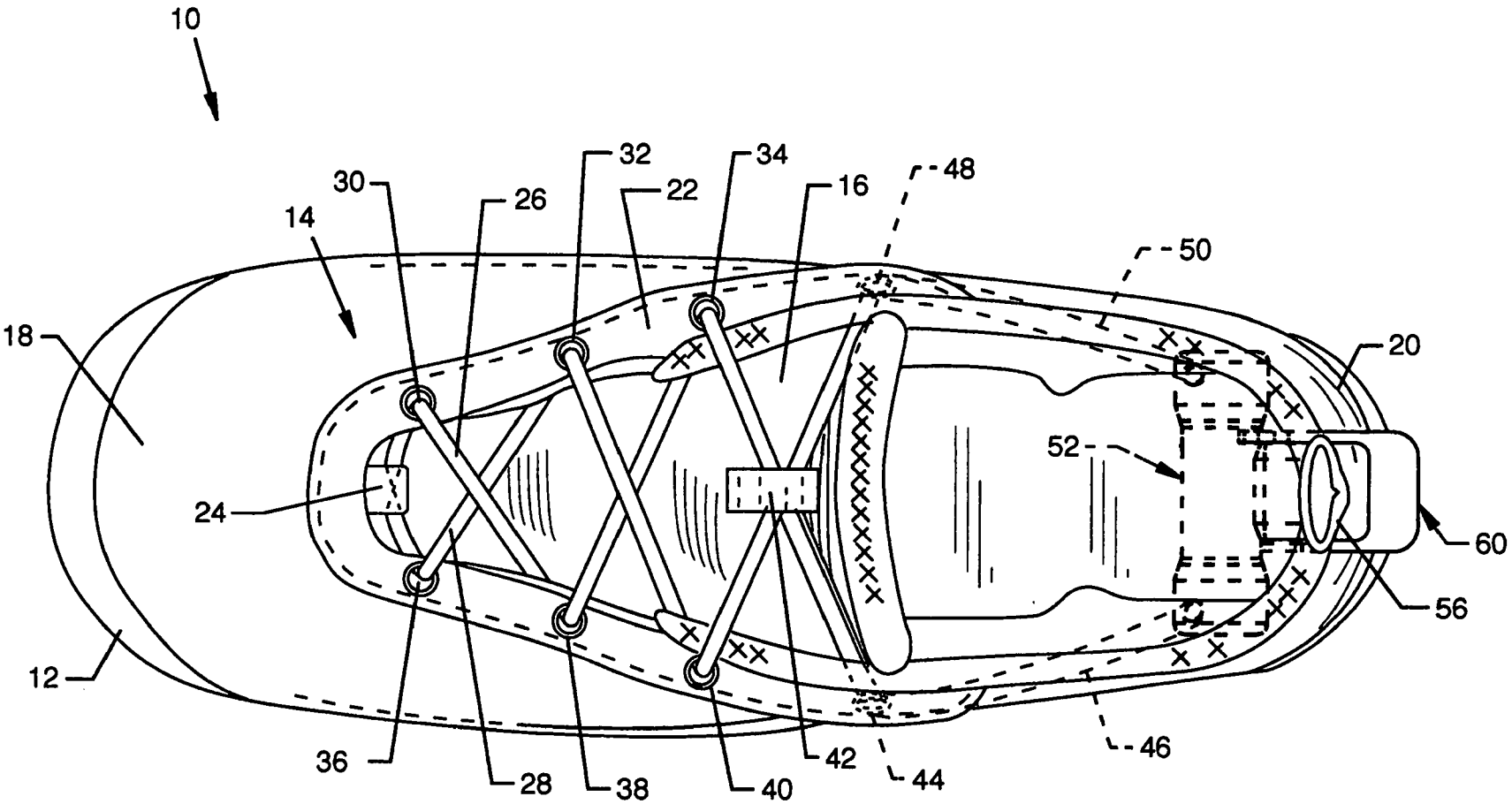
FIG. 1 illustrates a top view of an automated tightening shoe, the present invention.
Figure 2:
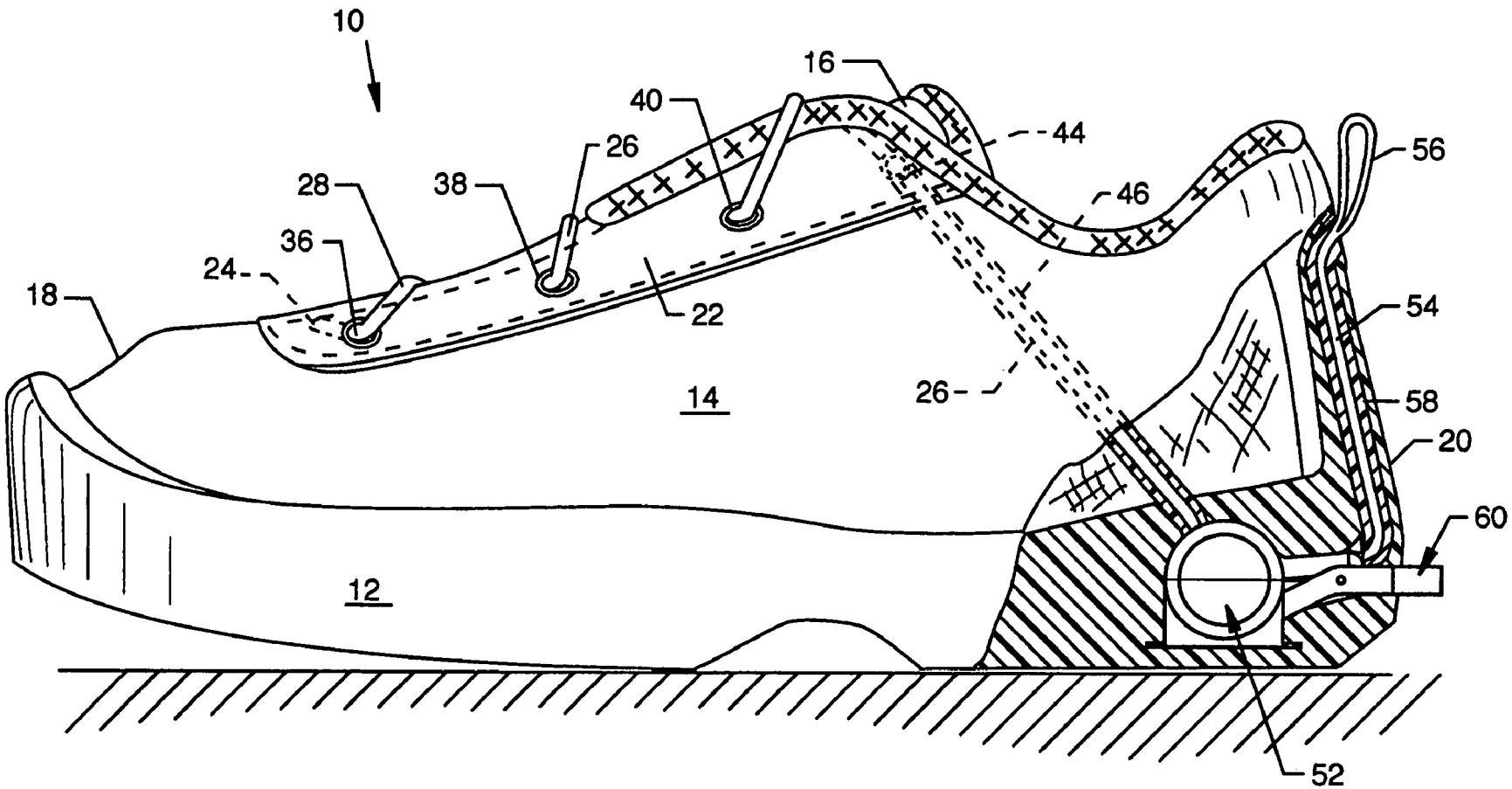
FIG. 2 illustrates a side view, in partial cutaway, of the automated tightening shoe.

FIG. 1 illustrates a top view of an automated tightening shoe 10, the present invention, and FIG. 2 illustrates a side view, in partial cutaway, of the automated tightening shoe 10.

The automated tightening shoe 10, as illustrated, is a sport or athletic shoe having a sole 12, an integral body member or shoe upper 14 including a tongue 16, a toe 18, a heel 20, and a reinforced lacing pad 22, all constructed of any common sport or athletic shoe materials. An anchoring fixture 24, which could be a loop or other geometric configuration, and which could be fabric, leather, plastic, metal, cloth or other suitable material, suitably secures to the forward regions of juncture of the tongue 16 and the reinforced lacing pad 22 to secure or anchor one end of each of the opposed shoe laces 26 and 28, preferably having a round cross section, but alternatively having a flat cross section. Preferably, the shoe laces 26 and 28 then mutually crisscross over the tongue 16 and pass through lace eyelets 30, 32, 34, 36, 38 and 40 mounted along and about the reinforced lacing pad 22, as illustrated, before passing through an optional lace containment loop 42 secured to the upper and outward portion of the tongue 16. After passing through lace containment loop 42, shoe lace 26 passes through a hole 44 in the reinforced lacing pad 22 and travels downwardly and rearwardly through a guide tube 46 or other suitable guide structure which passes in between the outer and inner materials of the shoe upper 14. In a similar fashion, the shoe lace 28 passes through a hole 48 in the reinforced lacing pad 22 and travels downwardly and rearwardly through a guide tube 50 which also passes in between the outer and inner materials of the shoe upper 14, as illustrated. The lower ends of guide tube 46 and guide tube 50 lead to and secure to a tightening mechanism 52 located in the heel 20 of the automated tightening shoe 10 to introduce the shoe laces 26 and 28, respectively, to the interior of the tightening mechanism 52 where shoe laces 26 and 28 leave guide tubes 46 and 50 and secure to components located interiorly of the tightening mechanism 52. The guide tubes 46 and 50 can be plastic tubes, cloth tubes or of other suitable material. The guide tubes 46 and 50 could be round, oval or other suitable shape to offer an unrestricted path of travel for the shoe laces 26 and 28 therethrough and to offer a low profile at the side of the integral body member or shoe upper 14.

An actuator cord 54 having an actuator loop 56 passes through a guide tube 58 located between the layers of fabric forming the upper region of the heel 20. The lower end of the guide tube 58 leads to and secures to the tightening mechanism 52 where the lower end of the actuator cord 54 leaves the guide tube 58 and secures to one or more components located interiorly of the tightening mechanism 52. There is also provided a release lever 60, being part of the tightening mechanism 52, which is pivotally secured to the structure of the tightening mechanism 52 and which passes through and projects from the lower region of the heel 20, which lower region has a flexible consistency. Downward actuation of the end of the release lever 60 functions to discontinue the tightening influence of the tightening mechanism 52 with the shoe laces 26 and 28 for subsequent removal of the automated tightening shoe 10 from the wearer. The projecting end of the release lever 60 is influenced and held in position by the flexible lower region of the heel 20. The release lever 60 acts to release the inner workings of the tightening mechanism 52 from a tightened state when the outwardly extending end is pressed downwardly. In the alternative, a spring can be incorporated between the release lever 60 and a convenient pivot point and anchor point to provide for suitable positioning of the release lever 60. The heel 20 suitably accommodates and encases the tightening mechanism 52 and can be formed around and about the tightening mechanism 52 and portions of the guide tubes of all sorts described herein. The heel 20 can be bifurcated to include shaped recesses, passages, and the like to accommodate the tightening mechanism 52 and the guide tubes of all sorts described herein; or, the tightening mechanism 52 and portions of the guide tubes of all sorts can be otherwise suitably accommodated according to the art.

Figure 3:
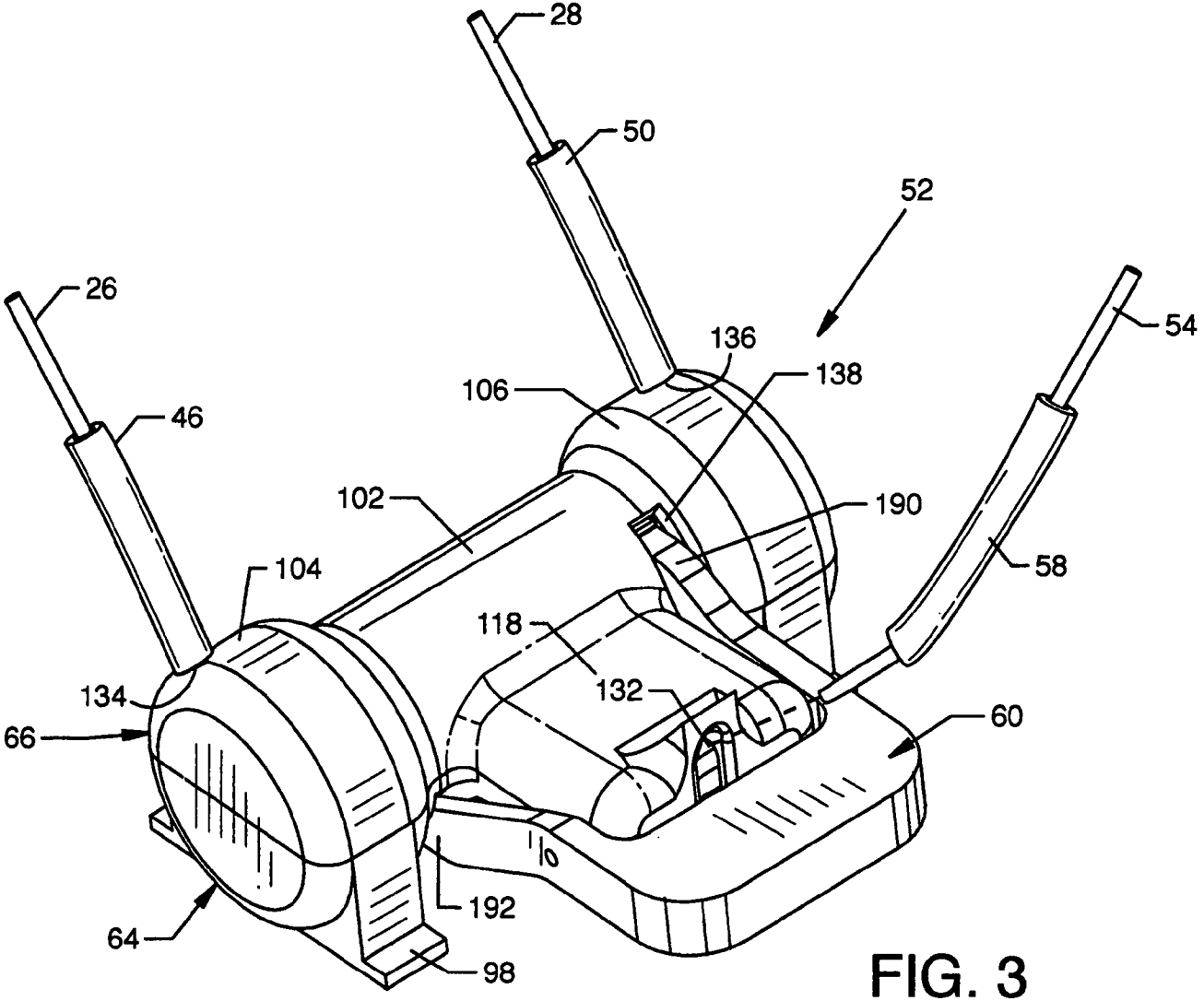
FIG. 3 is an isometric view of the outwardly visible components of the tightening mechanism.

FIG. 3 is an isometric view of the tightening mechanism 52 where outwardly visible components include opposing lower and upper housings 64 and 66 which mate to form enclosing structure resembling a configured closed cylinder to house and enclose inwardly located components, as described later in detail. In the alternative, other types and styles of housings or enclosures and other structures in lieu of the lower and upper housings 64 and 66 and associated structures can be incporporated to support and enclose the inwardly located components to form a tightening mechanism performing the same functions ass the tightening mechanism 52. In addition, structure having internal attributes similar to th upper and lower housing 66 and 64 could be molded into the heel 14 to accommodate mounting of the components comprising the mechanical structure 65. Also shown are the release lever 60, foreshortened guide tubes 46, 50 secured to tightening mechanism at the upper housing 66, and foreshortened shoe laces 26 and 28. The foreshortened guide tube 58 and actuator cord 54 are shown detached from the tightening mechanism 52.

Figure 4:
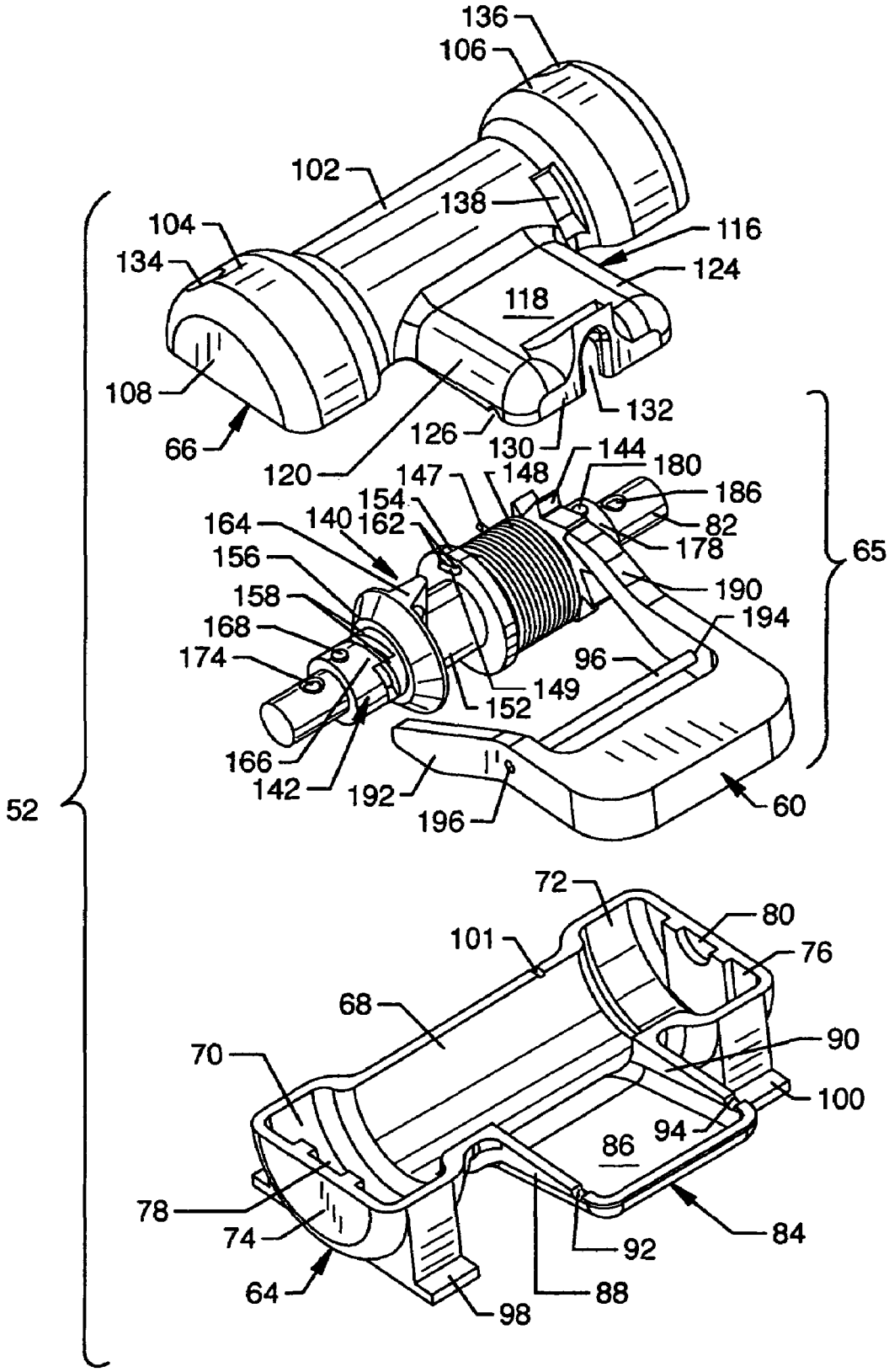
FIG. 4 is an exploded isometric topside view of the tightening mechanism showing the upper housing, the lower housing and mechanical structure therebetween.
Figure 7:
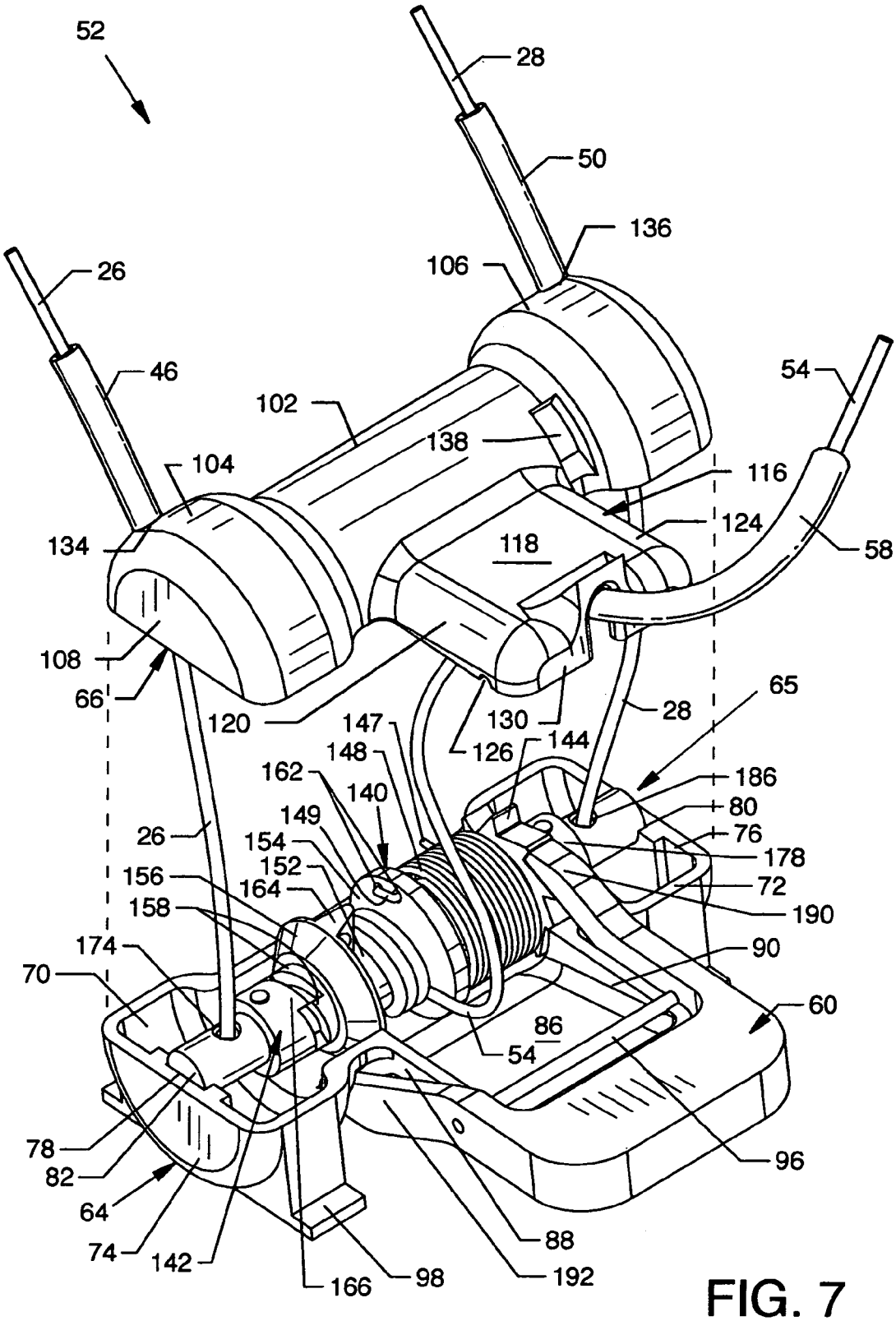
FIG. 7 is an exploded isometric view of the tightening mechanism where the mechanical structure is residing in the lower housing.

FIG. 4 is an exploded isometric topside view of the tightening mechanism 52 showing the upper housing 66, the lower housing 64, and mechanical structure 65 therebetween. The lower housing 64 includes a central body 68, being semi-cylindrical in shape, located between and being continuous with larger and opposed end bodies 70 and 72, also being semi-cylindrical in shape, where end bodies 70 and 72 additionally include planar ends 74 and 76, respectively. A journal box half 78 is located on one side of the planar end 74 facing into the end body 70, and another journal box half 80 is located on one side of the planar end 76 facing into the end body 72 each for partial support of a shaft 82, which is rotatable, of the mechanical structure 65, as shown in FIG. 7. Extending outwardly in perpendicular fashion and rearwardly from the central body 68 is a lower release lever support 84 including a horizontally aligned panel 86, a vertically aligned panel 88 extending upwardly from one edge of the panel 86, and another, opposed vertically aligned panel 90 extending upwardly from another edge of the panel 86. An upwardly oriented semi-circular notch 92 is located near the outboard end of the panel 88, and an opposing upwardly oriented semi-circular notch 94 is located near the outboard end of the panel 90 to offer partial support of an axle pin 96. An elongated mounting lug 98 is located along the underside of the end body 70 and an elongated mounting lug 100 is located along the underside of the end body 72. An upwardly facing semicircular notch 101 is located on the forwardly facing edge of the central body 68 for accommodation of one end 147 of a return spring 148 of the mechanical structure 65.

Figure 5:
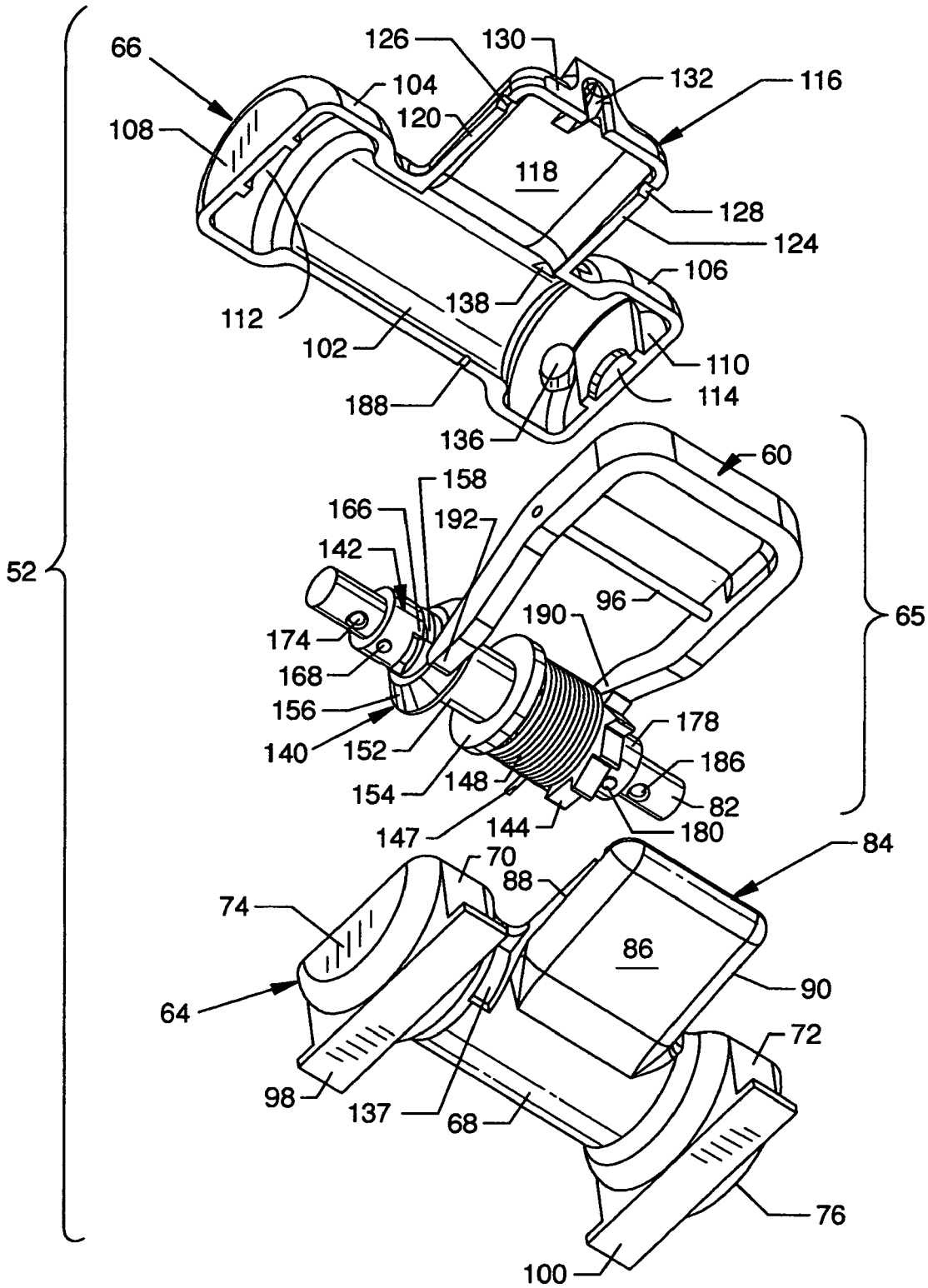
FIG. 5 is an exploded isometric underside view of the tightening mechanism showing the upper housing, the lower housing and mechanical structure therebetween.

FIG. 5 is an exploded isometric underside view of the tightening mechanism 52 showing the upper housing 66, the lower housing 64, and mechanical structure 65 therebetween. Shown in particular is the structure of the upper housing 66 where reference is understood to be made also to FIG. 4 which shows the outwardly visible structure thereof. The upper housing 66 includes a central body 102, being semi-cylindrical in shape, located between and being continuous with larger and opposed end bodies 104 and 106, also being semi-cylindrical in shape, where end bodies 104 and 106 additionally include planar ends 108 and 110, respectively. A journal box half 112 is located on one side of the planar end 108 facing into the end body 104, and another journal box half 114 is located on one side of the planar end 110 facing into the end body 106 each for partial support of the shaft 82 of the mechanical structure 65. Extending outwardly in perpendicular fashion and rearwardly from the central body 102 is an upper release lever support 116 including a horizontally aligned panel 118, a curved wall panel 120 extending downwardly from one edge of the panel 118, and another, opposed, curved wall panel 124 extending downwardly from another edge of the panel 118. A downwardly oriented semi-circular notch 126 is located near the outboard end of the curved wall panel 120, and an opposing downwardly oriented semi-circular notch 128 is located near the outboard end of the curved wall panel 124 to offer partial support of an axle pin 96 of the mechanical structure 65. A configured rearwardly facing panel 130 intersects panel 118, the curved wall panel 120, and curved wall panel 124, and includes a mounting formation 132, which can be a slot or a hole, for accommodation and securing of the lower end of the guide tube 58 which partially houses the actuator cord 54. Also included in the upper and forward facing regions of the end body 104 and the end body 106 are mounting holes 134 (FIG. 4) and 136 for accommodation of the guide tubes 46 and 50, respectively. Preferably, the mounting holes 134 and 136 are at a suitable angle to best accommodate the appropriate path of the guide tubes 46 and 50 through the integral body member or shoe upper 14. A cam actuator bar access orifice 137 is also included extending through the junction of the central body 68 and the end body 70 of the lower housing 64.

Figure 6:
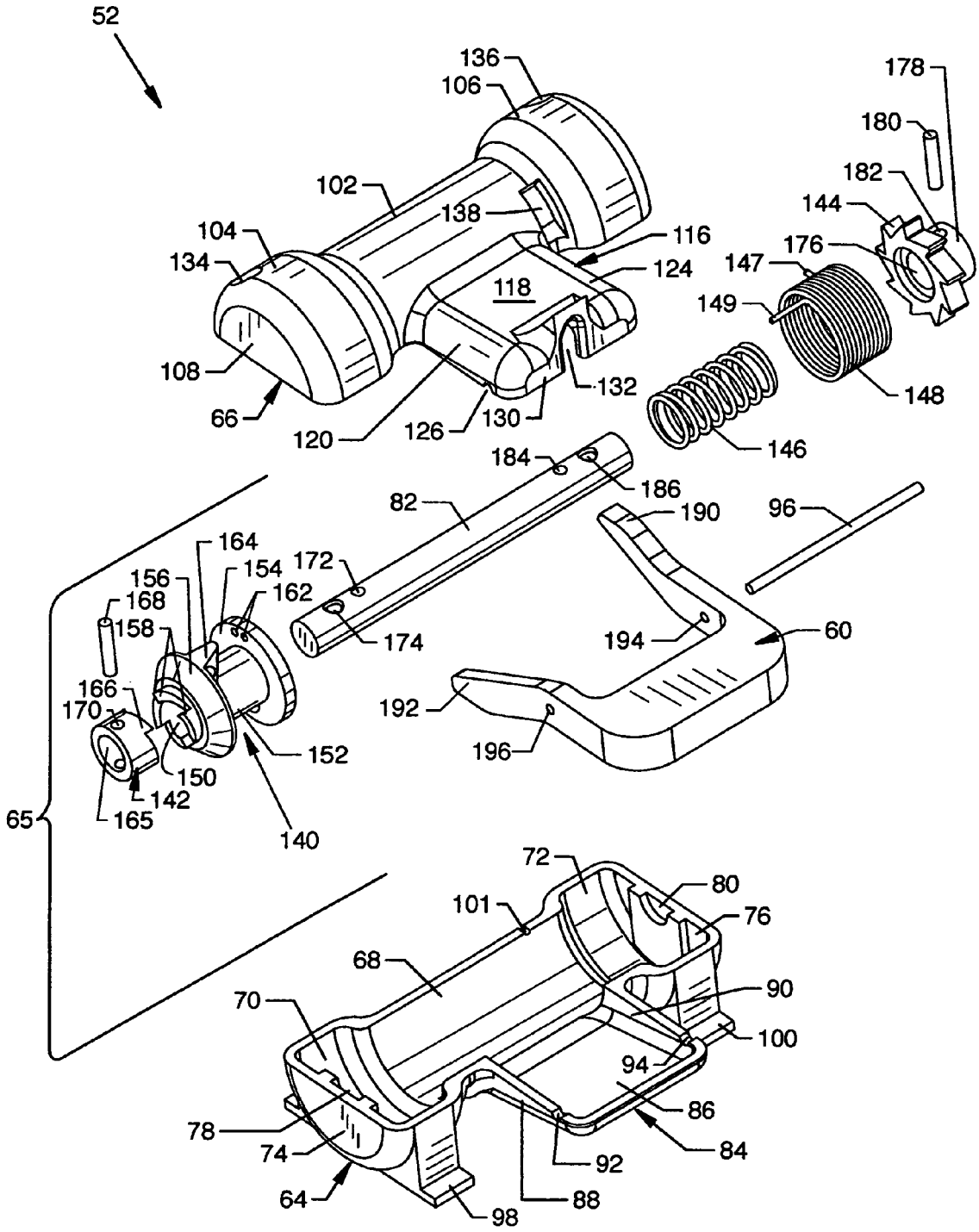
FIG. 6 is an exploded isometric view of the elements comprising the tightening mechanism.

FIG. 6 is an exploded isometric view of th elements comprising the tightening mechanism 52 including but not limited to the lower housing 64, the upper housing 66, and the mechanical structure 65 including the shaft 82, a ratcheted actuator spool 140, a ratcheted coupling collar 142, a ratchet wheel 144, a compression spring 146, the return spring 148, the release lever 60, and the axle pin 96.

With reference to FIG. 6 and FIG. 7, and other described figures, the structure and relationship of the elements comprising the tightening mechanism 52 is now described. The mechanical structure 65 centers about components either fixedly or slideably positioned and mounted along and about the shaft 82. One such component is the one-piece ratcheted actuator spool 140 which slidingly aligns along and about the shaft 82 and has a full length central bore 150 extending central to an actuator spool drum 152 having a flanking actuator spool disk 154 at one end and a flanking actuator spool cam disk 156 with a plurality of ratchet teeth 158 at the other end. Included in the actuator spool disk 154 are spring receptor holes 162. A holed actuator cord attachment flange 164 extends from the actuator spool cam disk 156 to the actuator spool drum 152 for attachment of the actuator cord 54 to the ratcheted actuator spool 140. Another such component which mounts along and about the shaft 82 is the ratcheted coupling collar 142 having a central bore 165 and plurality of ratchet teeth 166 at on end which fixedly attaches to the shaft 82 by a pin 168 driven through a hole set 170 of the ratcheted coupling collar 142 and through a pin receptor hole 172 near one end of th shaft 82. Also located near the pin receptor hole 172 near one end of the shaft 82 is a shoe lace attachment hole 174 which can be countersunk at one or more locations. Another such component which fixedly mounts along and about the shaft 82 is the ratchet wheel 144 having a central bore 176, which is countersunk to accommodate one end of the compression spring 146, where the central bore 176 is central to an integral ratchet wheel coupling collar 178 and central to the ratchet wheel 144. A pin 180 driven through a hole set 182 in the ratchet wheel coupling collar 178 and through a pin receptor hole 184 near another end of the shaft 82 secures the ratchet wheel 144 to the shaft 82. Also located near the pin receptor hole 184 near the other end of the shaft 82 is a shoe lace attachment hole 186 which can be countersunk at one or more locations.

Also positioned and mounted along and about the shaft 82 are the compression spring 146 and the return spring 148. The compression spring 146 also aligns between the countersunk end of the ratchet wheel 144 and the actuator spool disk 154 of the ratcheted actuator spool 140, thus urging the ratcheted actuator spool 140 toward the ratcheted coupling collar 142 and causing engagement of the plurality of ratchet teeth 158 of the ratcheted actuator spool 140 with the plurality of ratchet teeth 166 of the ratcheted coupling collar 142. Such an engaged relationship takes place and is useful during the tightening of the shoe laces 26 and 28 where the actuator cord 54, pre-wound about the ratcheted actuator spool 140, is pulled, whereby the plurality of ratchet teeth 158 of the ratcheted actuator spool 140 positively engage the plurality of ratchet teeth 166 of the ratcheted coupling collar 142 to cause rotation of the shaft 82 to windingly tighten the shoe laces 26 and 28 about the opposing ends of the shaft 82. Co-located with the compression spring 146 is the return spring 148 one end 147 of which is anchored between the semicircular notch 101 in the lower housing 64 and a facing semicircular notch 188 (FIG. 5) in the upper housing 66, and the other end 149 of which is fashioned to secure in the spring receptor holes 162 in the actuator spool disk 154 of the ratcheted actuator spool 140. In such an engaged relationship, the rotation of the shaft 82 is springingly countered to urge rotation of the shaft 82 in a direction opposing the rotational direction utilized for shoe lace tightening. The release lever 60 includes a pawl 190 and an opposed cam actuator bar 192 extending from the main body of the release lever, the pawl and cam actuator bar having holes 194 and 196, respectively, therethrough for receipt of the axle pin 96. The pawl 90 interfaces with the ratchet wheel 144 and the cam actuator bar 192 interfaces with the ratcheted actuator spool 140 to influence the rotational positioning of the shaft 82. A pawl access orifice 138 is included in the upper housing 66 extending through the junction of the central body 102 and the end body 106. The stationary relationship of the release lever 60 and the features incorporated therein to the shaft 82, the ratcheted actuator spool 140, the ratchet wheel 144, and other adjacent components is best viewed in FIG. 4 where the pawl 190 is engaged with the ratchet wheel 144 and where the cam actuator bar 192 is in close proximity to the actuator spool cam disk 156 of the ratcheted actuator spool 140.

FIG. 7 is an exploded isometric view of the tightening mechanism 52 where the mechanical structure 65 is residing in the lower housing 64. The shoe laces 26 and 28 are shown passing through the guide tubes 46 and 50, through the upper housing 66, and connected to the shaft 82 at shoe lace attachment holes 174 and 186, respectively. The actuator cord 54 is shown passing through the guide tube 58 and thence coiled partially about the actuator spool drum 152 of the ratcheted actuator spool 140. The opposing ends of the shaft 82 are supported in part by the journal box halves 78 and 80 and in part by the corresponding journal box halves 112 and 114, shown in FIG. 5.

Mode of Operation

Figure 8:
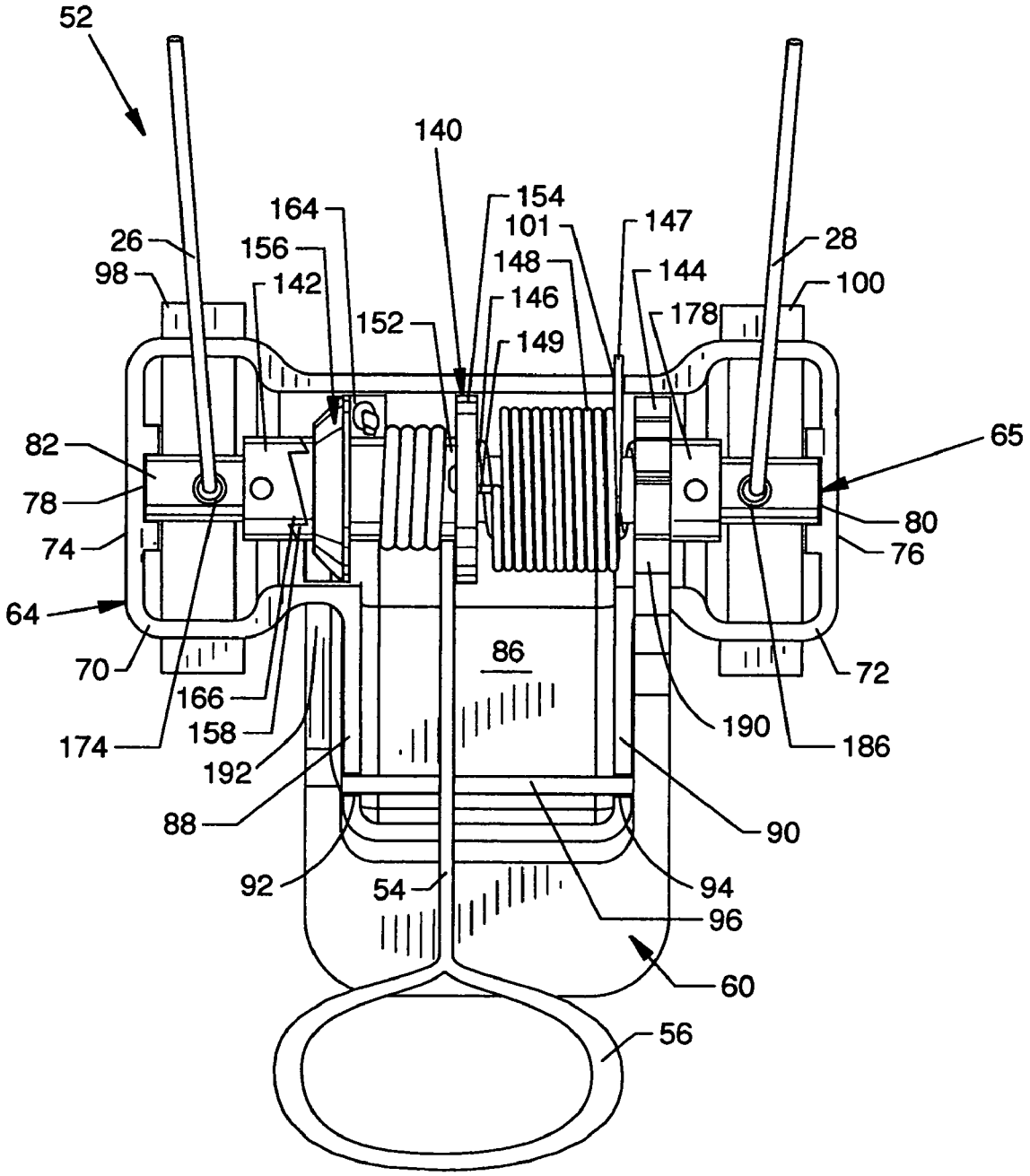
FIG. 8 is a top view of the tightening mechanism in the inactive mode awaiting the tightening process.
Figure 9:
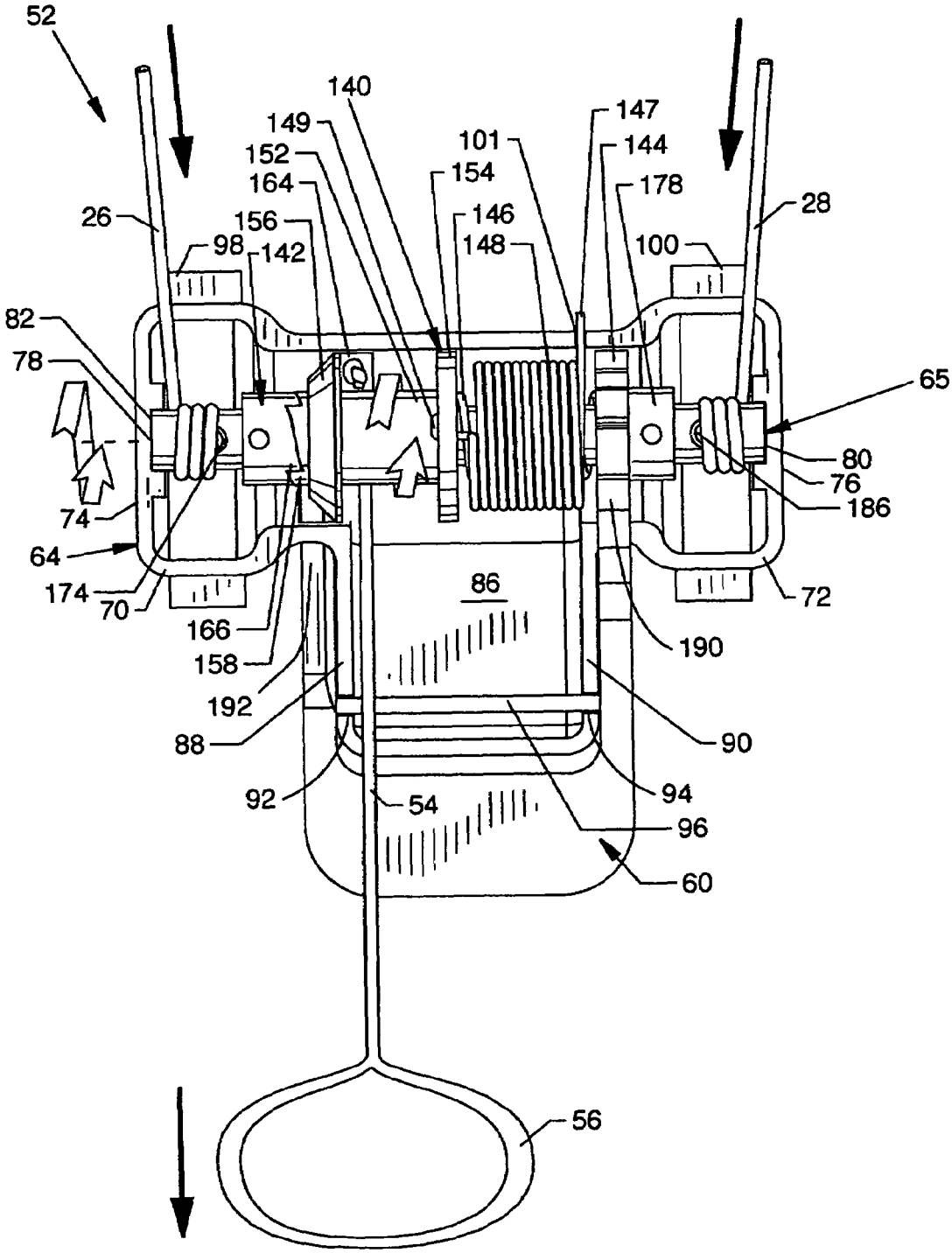
FIG. 9 is a top view of the tightening mechanism in the last stage of the tightening mode where the shoe laces have been tightened.
Figure 10:
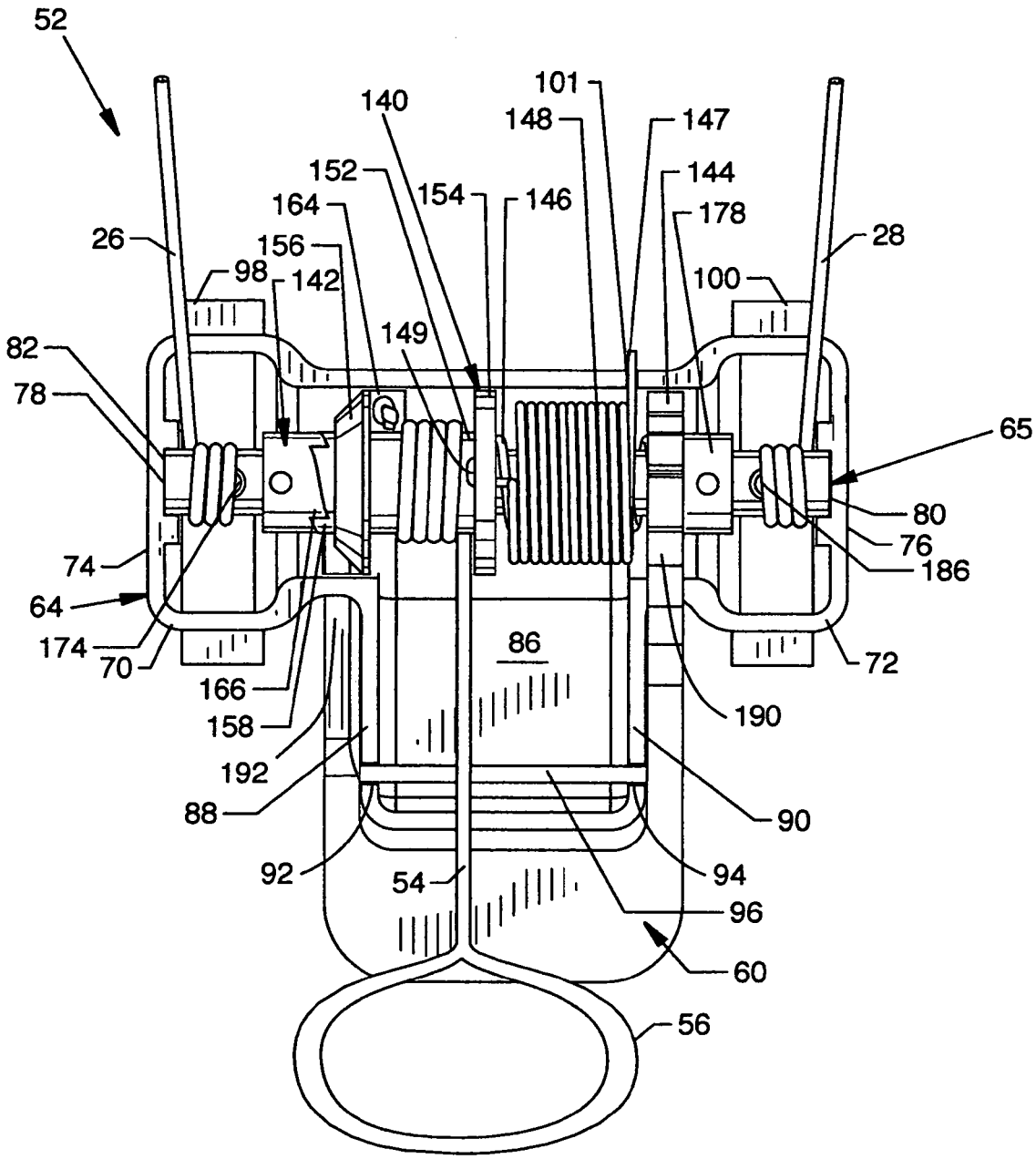
FIG. 10 is a top view of the tightening mechanism in the tightened/recoiled mode.
Figure 11:
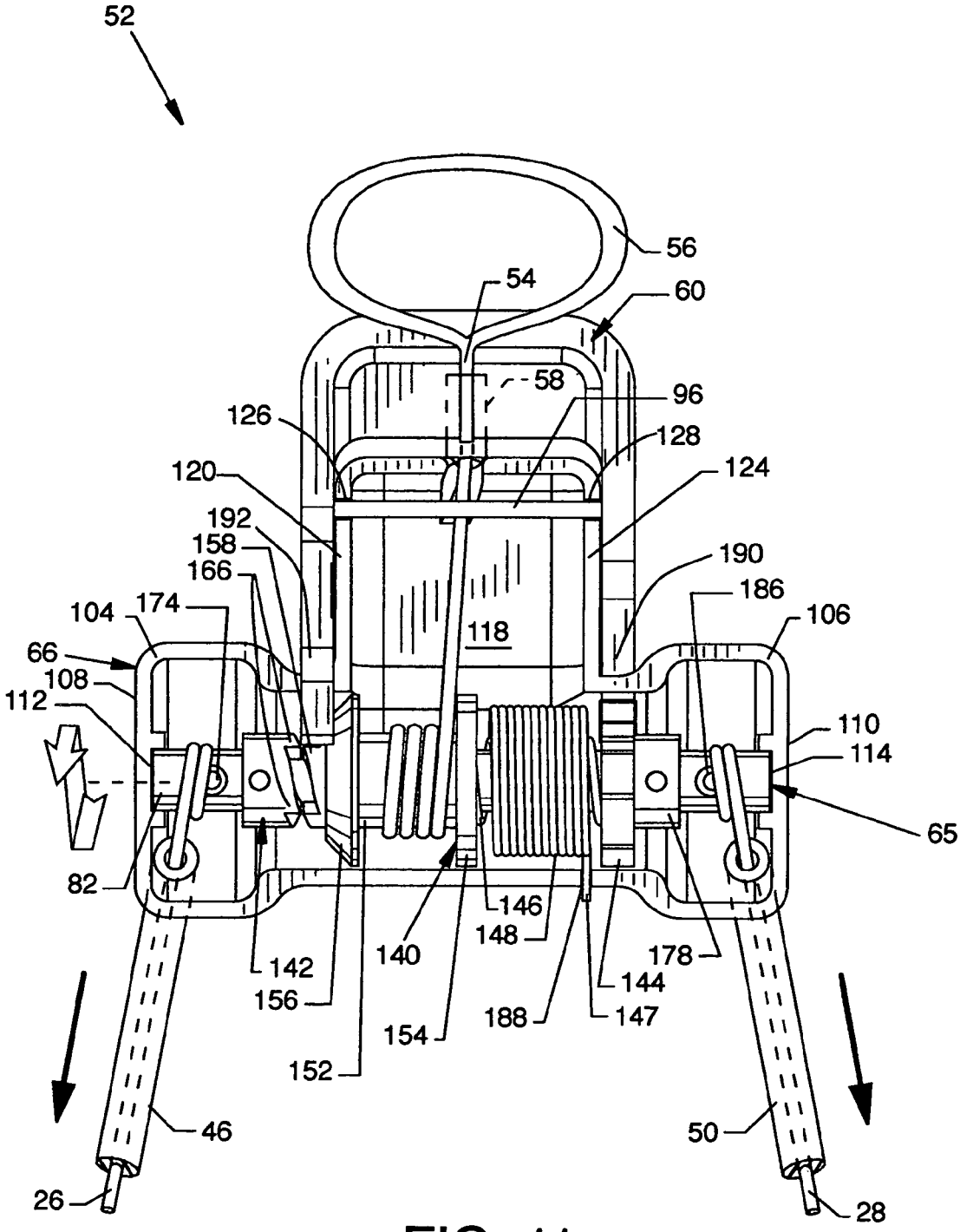
FIG. 11 is a bottom view of the tightening mechanism in the release mode where the shoe laces are released from the tightening influence of the tightening mechanism.

FIGS. 8, 9, 10 and 11 best illustrate the mode of operation of the automated tightening shoe 10 where reference is made to elements previously described in previous figures. Central to the operation of the invention is the tightening mechanism 52, where FIG. 8 shows a top view of the tightening mechanism 52 in the inactive mode awaiting the tightening process, FIG. 9 shows a top view of the tightening mechanism 52 in the last stage of the tightening mode where the shoe laces 26 and 28 have been tightened, FIG. 10 shows a top view of the tightening mechanism 52 in the tightened/recoiled mode, and FIG. 11 is a bottom view of the tightening mechanism 52 in the release mode where the shoe laces 26 and 28 are released from the tightening influence of the tightening mechanism 52. For purposes of brevity and clarity, the guide tubes 46, 50 and 58 are not necessarily shown. For uniformity of discussion and reference regarding rotation of the shaft 82 or components mounted thereupon or thereabout, direction of rotation is referenced to a view from the end of the shaft 82 adjacent to the end body 70.

FIG. 8 shows a top view of the tightening mechanism 52 in the inactive mode awaiting the tightening process. In the illustration, the tightening mechanism 52 is shown in the lower housing 64. The shoe laces 26 and 28 are loose in the lace eyelets 30, 32, 34, 36, 38 and 40, allowing the tongue 16 to be positioned toward the shoe laces 26 and 28, thereby allowing the user to insert his foot into the automated tightening shoe 10. Although the tightening mechanism 52 is still in the inactive mode, forces are continually applied along the shaft 82 by the compression spring 146 to influence and cause the ratcheted actuator spool 140 to be positioned toward the ratcheted coupling collar 142, whereby the plurality of ratchet teeth 158 of th ratcheted actuator spool 140 are forced into intimate contact and engagement with the plurality of ratchet teeth 166 of the ratcheted coupling collar 142. Such engagement is beneficial to uni-directional actuation of the connected shaft 82 for tightening of the shoe laces 26 and 28 as caused by rotation of the ratcheted actuator spool 140 in a counterclockwise direction as viewed from the end of the shaft 82 adjacent to the end body 70. Also influencing rotation of the shaft 82 is the release lever pawl 190 at one inwardly located end of the release lever 60 which successively and forcefully engages the ratchet teeth of the ratchet wheel 144 where such engagement maintains the position of the shaft 82 against reverse (clockwise) rotation when the shaft 82 is rotated in the counterclockwise direction. One end of the actuator cord 54 is attached such as by a knot in one end engaging the holed actuator cord attachment flange 164 and is coiled about the actuator spool drum 152. For purposes of illustration, the shoe laces 26 and 28 are shown entering the shoe lace attachment holes 174 and 186 from the top. Preferably, each of the shoe laces 26 and 28 would enter the shoe lace attachment holes 174 and 186 from the opposite side of the shaft 82 and would secure thereto preferably by a knot which engages a countersunk portion of the respective shoe lace attachment holes 174 and 186 to achieve a flush mount. Other suitable methods of attachment of the shoe laces 26 and 28 to the shaft 82 can also be incorporated.

FIG. 9 shows the tightening mechanism 52 just after the last stage of the tightening mode where the shoe laces 26 and 28 have been tightened sufficiently in a direction indicated by adjacent dark arrows and the tightening mechanism 52 awaits the tightened/recoiled mode. In the illustration, the tightening mechanism 52 is shown in the lower housing 64. During the tightening mode, the actuator loop 56 is manually positioned to reposition and uncoil the actuator cord 54 outwardly, thereby forcing and causing the ratcheted actuator spool 140, the ratcheted coupling collar 142, and the shaft 82 to rotate in a counterclockwise direction as shown, whereupon the shoe laces 26 and 28 tighteningly coil over and about the opposite ends of the shaft 82, thereby tightening the shoe laces 26 and 28 of the automated tightening shoe 10. During counterclockwise rotation of the shaft 82, the pawl 190 ratchetingly engages the ratchet teeth of the ratchet wheel 144 preventing meaningful rotational slippage in a reverse clockwise direction during tightening and during the static tightened mode. The static tightened mode incorporates the engagement of the pawl 190 with the ratchet wheel 144 to maintain tension on the shoe laces 26 and 28 during the static tightened mode.

During the tightening mode, a one-way clutch-like positive engagemental relationship is maintained in one rotational direction between the ratcheted actuator spool 140 and the ratcheted coupling collar 142 during counterclockwise rotation. In this relationship, the return spring 148 is wound and tightened, thereby storing energy to be directed in an opposing and clockwise direction, thereby urging the ratcheted actuator spool 140 in a clockwise direction to foster clockwise rotation of the ratcheted actuator spool 140 in a clockwise direction, when required. Force from the return spring 148 overcomes the minute and weak frictional engagement of the ratcheted actuator spool 140 and the ratcheted coupling collar 142 offered in a clockwise direction. Accordingly, a slipping weak engagemental relationship is also maintained in an opposite rotational direction (clockwise) between the ratcheted actuator spool 140 and the ratcheted coupling collar 142 during clockwise rotation of the ratcheted actuator spool 140. During rotation of the ratcheted actuator spool 140 in either direction, the tightened rotational state of the shaft 82 is maintained by engagement of the pawl 190 with the ratchet wheel 144. Such relationships, as described above, cause and allow the actuator cord 54 to be automatically retracted into the tightening mechanism 52 and stored as a coil about the actuator spool drum 152 of the ratcheted actuator spool 140, while still maintaining the shoe laces 26 and 28 in a tightened state. In the alternative, short actuations of the actuator cord 54 can be repeated to incrementally tighten the shoe laces 26 and 28.

FIG. 10 shows the tightening mechanism 52 in the tightened/recoiled mode where the automated tightening shoe 10 has been secured to the foot of a user and ready for use. In the illustration, the tightening mechanism 52 is shown in the lower housing 64. In the illustration, the actuator cord 54 has been automatically coiled and stored about the actuator spool drum 152 of the ratcheted actuator spool 140 by the recoiling action of the return spring 148.

FIG. 11 illustrates the tightening mechanism 52 in the release mode where the shoe laces 26 and 28 are released from the tightening influence of the tightening mechanism 52. In the illustration, the tightening mechanism 52 is shown in the upper housing 66. The release mode is accomplished by actuation of the end of the release lever 60 downwardly either manually or by using the toe portion or other portion of the opposite shoe or foot followed by or including simultaneous flexing in a forward and upward direction of the dorsal (upper) region of the foot contained in the subject automated tightening shoe 10. Such urging of the release lever 60 end downwardly causes the release lever 60 to pivot about the axle pin 96, thereby simultaneously affecting the relationship of the pawl 190 to the ratchet wheel 144 and affecting the relationship of the cam actuator bar 192 to the ratcheted actuator spool 140. The changing relationships of the above components cause freewheeling of the shaft 82 so that the shoe laces 26 and 28 may be loosened. During such actuation and event, the pawl 190 is removed from intimate contact with the teeth of the ratchet wheel 144, thereby allowing the ratcheted actuator spool 140 and shaft to freewheel. Also, during such actuation and event, the cam actuator bar 192 contacts the actuator spool cam disk 156, which is beveled, to urge the ratcheted actuator spool 140 toward center to discontinue any relationship of the ratcheted coupling collar 142 and the ratcheted actuator spool 140 to which the actuator cord 54 is secured, thereby leaving the ratcheted actuator spool 140 and attached actuator cord 54 rotationally untouched and unencumbered by any attachment thereto by the ratcheted coupling collar 142 (i.e., the winding means is totally disassociated from engagement with the ratcheted coupling collar 142 to allow freewheeling of the shaft 82). Such action leaves the actuator cord 54 coiled about the actuator spool drum 152 of the ratcheted actuator spool 140 in readiness for the next tightening event. As the user flexes the dorsal region of the foot forwardly and upwardly, the shoe laces 26 and 28 are urged upwardly and forwardly thereby tensioning the shoe laces 26 and 28 and causing the shaft to rotate in a clockwise direction to uncoil the shoe laces 26 and 28 from the ends of the shaft 82 and to loosen so that the user may remove his foot from the automated tightening shoe 10.

Figure 12:
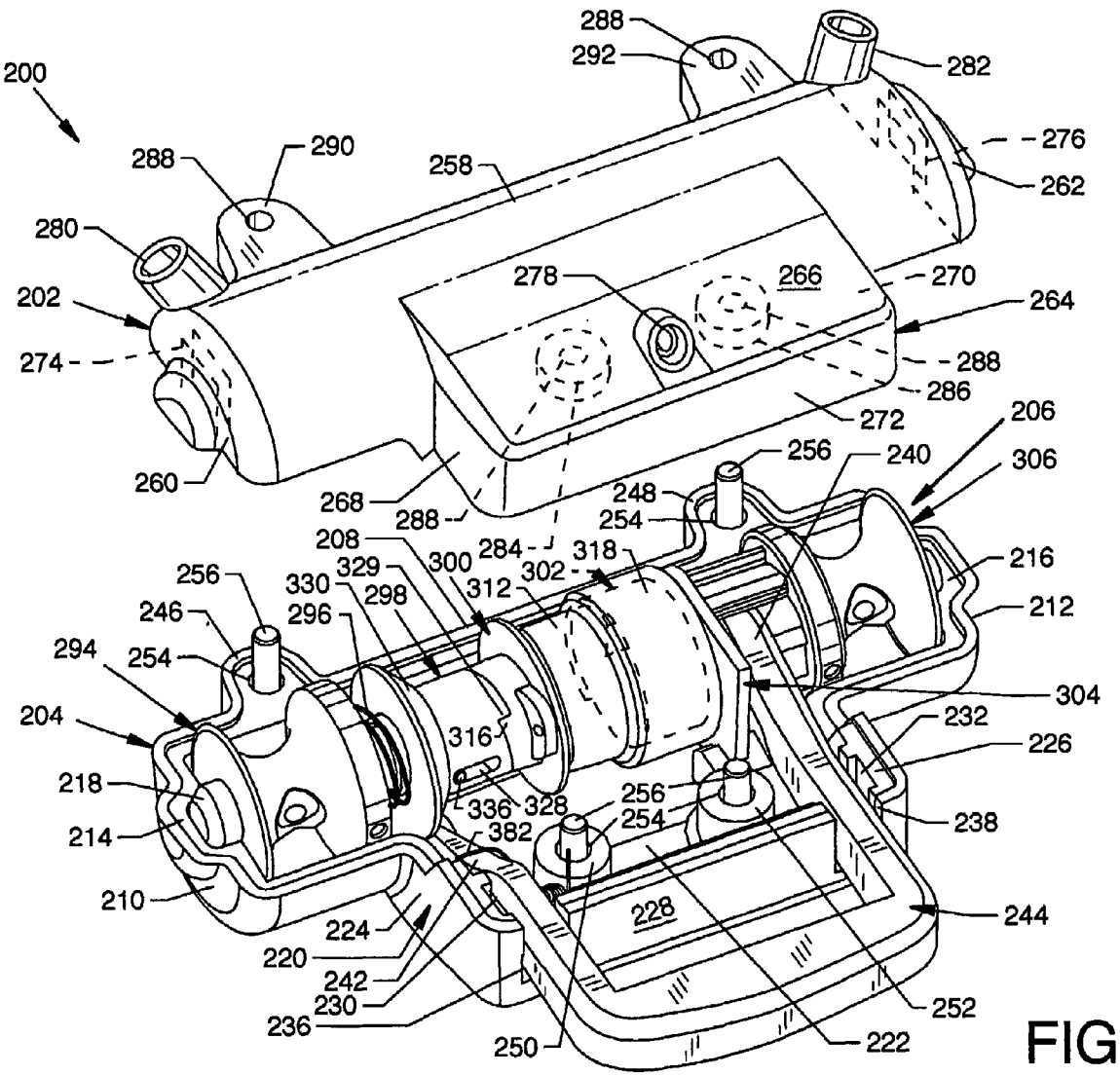
FIG. 12, an alternative embodiment, is an isometric topside view of a tightening mechanism which can be utilized in lieu of a previously disclosed tightening mechanism.
Figure 14:
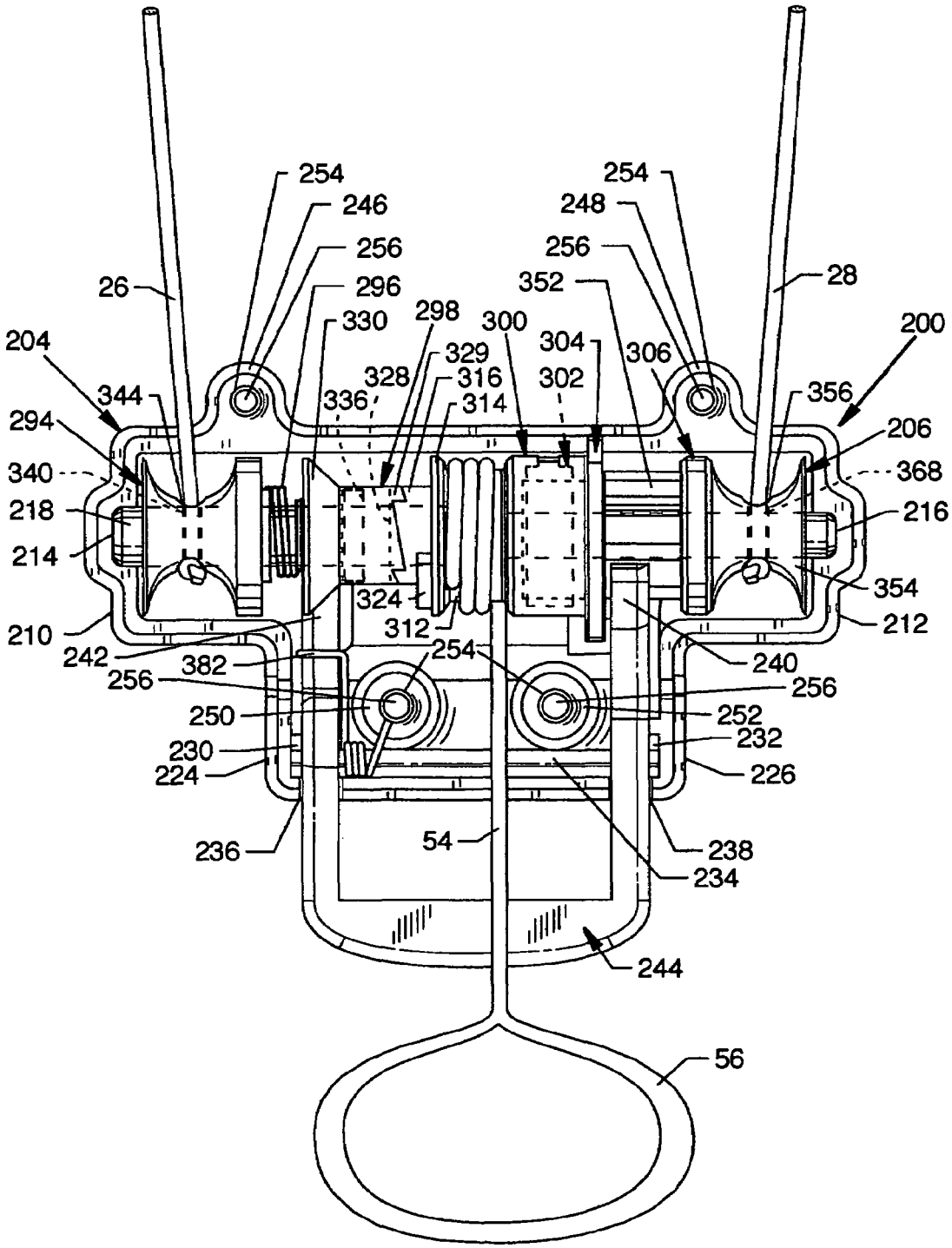
FIG. 14 is a top view of the tightening mechanism of the alternative embodiment in the inactive mode awaiting the tightening process.

FIG. 12, an alternative embodiment, is an isometric topside view of a tightening mechanism 200 which can be utilized in lieu of the tightening mechanism 52. The figure shows an upper housing 202 removed from a lower housing 204 and mechanical structure 206 residing in the lower housing 204. In the alterantive, other types and styles of housing or enclosures, an alternative embodiment, in lieu of the lower and upper housings 204 and 202 and associated structures can be incorporated to support and enclose the inwardly located components to form a tightening mechanism performing the same functions as the tightening mechanism 200. In addition, structure having internal mounting attributes similar to the upper and lower housings 204 and 202 could be molded into the hell 14 to accommodate mounting of the components comprising the mechanical structure 206. The mechanical structure 206 includes components correspondingly similar to those of the mechanical structure 65, but reconfigured and redistributed to form the tightening mechanism 200 for the tightening of the shoe laces 26 and 28. The lower housing 204 includes a central body 208 which is substantially semi-cylindrical in shape and which has configured ends 210 and 212 which are also substantially semi-cylindrical in shape. A journal box half 214 is located on one side of the end 210 facing into the center of the lower housing 204 and an opposing journal box half 216 is located on one side of the end 212 facing into the center of the lower housing 204 for partial support of a shaft 218 of the mechanical structure 206. Extending outwardly in perpendicular fashion and rearwardly from the central body 208 is a lower release lever support 220 including a horizontally aligned panel 222, a vertically aligned panel 224 extending upwardly from one edge of the panel 222, an opposed vertically aligned panel 226 extending upwardly from another edge of the panel 222, and a vertically aligned panel 228 extending upwardly from a third edge of the panel 222 as well as extending between the panels 224 and 226. A vertically oriented notch 230 located near the outboard end of the panel 224 and an opposing vertically oriented notch 232 located near the outboard end of the panel 226 offer partial support of the ends of an axle pin 234, as shown in FIG. 14. Opposed notches 236 and 238 located on panel 228 accommodate the outward portions and vertical movement of an opposed cam actuator bar 242 and a pawl 240 of a release lever 244. Exterior mounting fixtures 246 and 248 integral to the structure of the lower housing 204 are located along the forward portion of the central body 208, and interior mounting fixtures 250 and 252 integral to the structure of the lower housing 204 are located on the panel 222. Each mounting fixture 246, 248, 250 and 252 includes an alignment hole 254. Alignment pins 256, which can extend upwardly from the interior of the heel 20, are shown engaging and extending through and beyond the alignment holes 254 in order to engage corresponding alignment holes 288 in corresponding components in the upper housing 202 in order to mate the upper housing 202 and the lower housing 204, thereby also securing the upper housing 202 and the lower housing 204 to the heel 20. Adhesive applied to some or all of the alignment pins 256 and alignment holes 254 and other mating portions of the upper housing 202 and the lower housing 204 can be incorporated to join the corresponding members of the upper housing 202 and the lower housing 204 and to secure the upper housing 202 and the lower housing 204 to the heel 20. In the alternative, and in lieu of the alignment holes 254, th alignment pins 256 could be part of and integral to the lower housing 204 and extend upwardly to engage and join the corresponding members of the upper housing 202. Further, other suitable means could be incorporated to join the upper housing 202 to the lower housing 204.

The upper housing 202 includes a central body 258 which is substantially semi-cylindrical in shape and which has configured opposed ends 260 and 262 which are also substantially semi-circular in shape. A journal box half 274 is located on one side of the end 260 facing into the center of the upper housing 202 and an opposing journal box half 276 is located on one side of the end 262 facing into the center of the upper housing 202 for partial support of the shaft 218 of the mechanical structure 206. Extending outwardly and rearwardly from the central body 258 is an upper release lever support cover 264 having a plurality of panels each extending outwardly and rearwardly from the central body 258 including a horizontally aligned panel 266, a vertically aligned panel 268 and an opposed vertically aligned panel 270 extending downwardly from opposing edges of the panel 266 and another panel 272 extending downwardly from an outer and rearward edge of the panel 266 whereat panels 266, 268, 270, 272 intersect, as illustrated. A mounting formation 278, which preferably is a hole for accommodation and securing of the lower end of the guide tube 58 which partially houses the actuator cord 54, is located on the panel 266. Included at the intersections of the central body 258 and the upper and forward facing regions of the end 260 and the end 262 are opposed mounting fixtures 280 and 282, preferably being tubular, for accommodation of the guide tubes 46 and 50, respectively. Preferably, the mounting fixtures 280 and 282 extend at a suitable angle to best accommodate the appropriate path of the guide tubes 46 and 50 through the integral body member or shoe upper 14. Interior mounting fixtures 284 and 286 each having an alignment hole 288 on the underside of the upper release lever support cover 264 align to corresponding interior mounting fixtures 250 and 252 on the lower release lever support 220 as well as aligning to and accommodating alignment pins 256. Exterior mounting fixtures 290 and 292 each having an alignment hole 288 extend forwardly from the central body 258 and align to corresponding exterior mounting fixtures 246 and 248 on the lower housing 204 as well as aligning to and accommodating alignment pins 256, respectively.

The mechanical structure 206 includes the shaft 218 which slidingly, fixedly or otherwise accommodates a plurality of components aligned along and about the shaft 218 including at least a drum 294, a compression spring 296, a ratcheted cam disk 298, a ratcheted actuator spool 300, a return spring 302, a return spring mount 304, a ratcheted drum 306, and other components, described later in detail.

Figure 13:
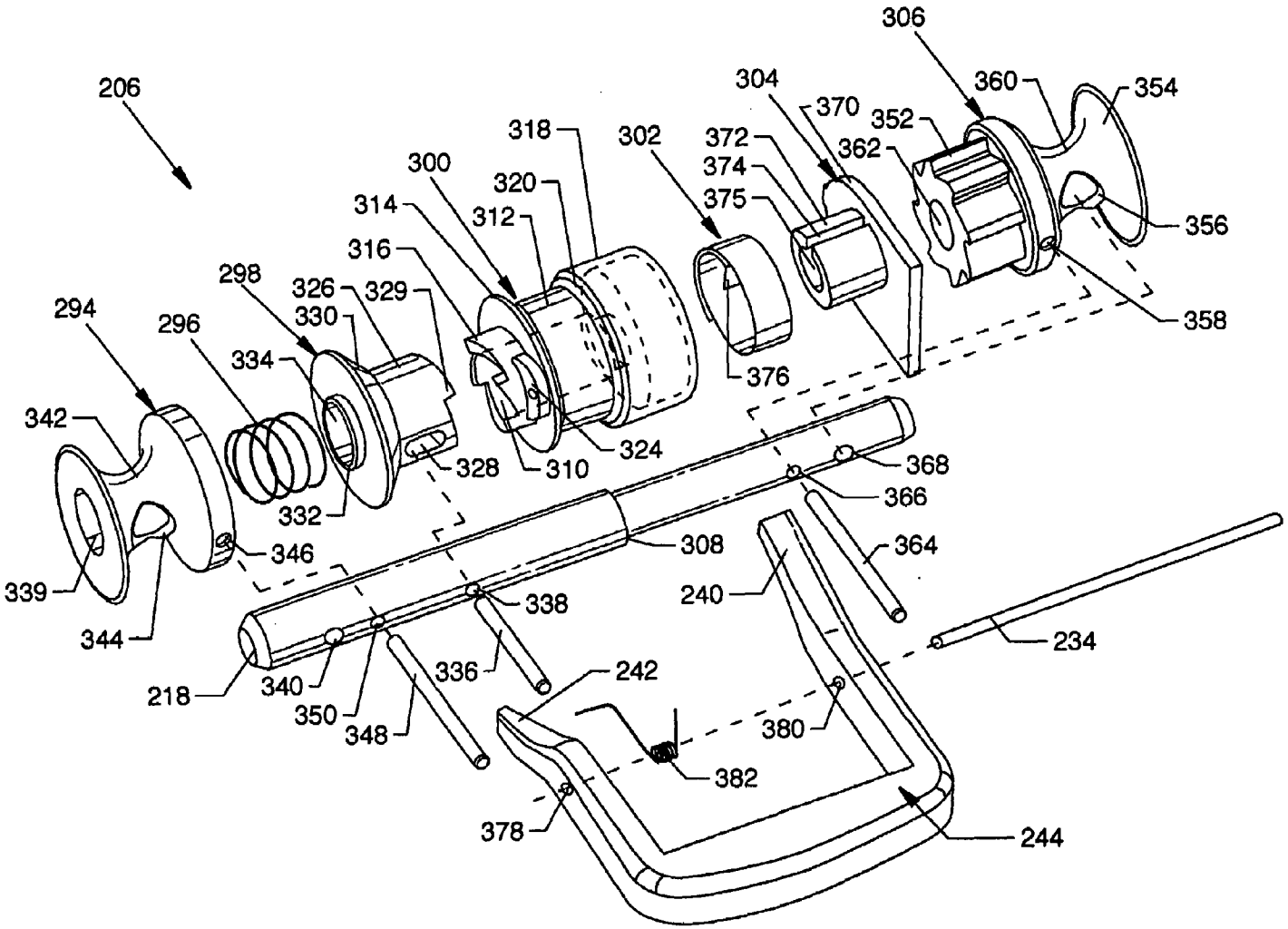
FIG. 13 is an exploded isometric view of the mechanical structure of the alternative embodiment.

FIG. 13 is an exploded isometric view of the mechanical structure 206 including the shaft 218, the drum 294, the compression spring 296, the ratcheted cam disk 298, the ratcheted actuator spool 300, the return spring 302, the return spring mount 304, the ratcheted drum 306, the release lever 244, an axle pin 234, a positioning spring 382 and other components described later in detail.

With reference to FIG. 13 and FIG. 14, and other described figures, the structure and relationship of the elements comprising the tightening mechanism 200 is now described. For uniformity of discussion and reference regarding rotation of the shaft 218, or components mounted thereupon or thereabout, direction of rotation is referenced to a view from the end of the shaft 218 adjacent to the end 210.

The mechanical structure 206 centers about components either fixedly or slideably or rotationally positioned and mounted along and about the shaft 218. Th shaft 218 is a multi-radius shaft including an annular shoulder 308 which engages a mating annular surface interior to the ratcheted actuator spool 300 (not shown) to restrict movement of the ratcheted actuator spool 300 toward the larger radiused portion of the shaft 218. The one-piece ratcheted actuator spool 300 is an example of such a component fixedly, or slideably, or rotationally positioned and mounted along and about the shaft 218 which rotatingly aligns to and about the shaft 218. The ratcheted actuator spool 300 has a central bore 310 extending central to an actuator spool drum 312, a flanking actuator spool disk 314, and ratchet teeth 316 at one end, all of which extend along and about the centerline of the ratcheted actuator spool 300. Also included in the actuator spool disk 300 is a spring housing 318 where an edge of the outwardly located visible structure of the spring housing 318 forms an annular surface 320 opposing the actuator spool disk 314 where the actuator spool disk 314, the actuator spool drum 312, and the annular surface 320 comprise a spool for containment of the actuator cord 54 as appropriate. Also included on one side of the actuator spool disk 314 is a holed actuator cord attachment flange 324 for appropriate attachment of the actuator cord 54 to the ratcheted actuator spool 300.

Another such component which mounts fixedly or slideably or rotationally positions and mounts along and about the shaft 218 is the ratcheted cam disk 298 aligned over and about the shaft 218. The ratcheted cam disk 298 includes a central body 326. The tubular-like central body 326 includes an elongated slot 328 perpendicular to the central axis of the central body 326 and extending through the central body 326, as well as intersecting a central bore 334. A plurality of ratchet teeth 329 are located at one end of the central body 326 for engagement with the plurality of ratcheted teeth 316 of the ratcheted actuator spool 300. A cam disk 330 and an annular spring locator 332 are located at the end of the central body 326 opposite to the end of the central body 326 having the plurality of ratchet teeth 329. The central bore 334 extends central to the spring locator 332, the central body 326 including the elongated slot 328, and the plurality of ratchet teeth 329. A locating pin 336 frictionally engages a pin receptor hole 338 in the shaft 218. The locating pin 336 is of sufficient length so that both ends thereof extend beyond the circumference of the shaft 218 at both sides whereby both ends of the locating pin 336 opposingly extend to engage the elongated slot 328, thereby slidingly coupling the shaft 218 and the ratcheted cam disk 298. Such a relationship allows the ratcheted cam disk 298 to be slidingly positioned along the shaft 218 a distance determined by the engagement of the locating pin 336 with the finite length elongated slot 328. Yet another relationship is that where rotation of the ratcheted cam disk 298 in either direction about the central axis of the ratcheted cam disk 298 causes subsequent rotation of the shaft 218 about the central axis of the shaft 218. The later relationship is reversible in that rotation of the shaft 218 causes like rotation of the ratcheted cam disk 298. Thus, sliding communication and rotational communication between the shaft 218 and the ratcheted cam disk 298 is established.

A shoe lace attachment hole 340, which may be countersunk at one or more locations, is located near one end of the shaft 218. Drum 294, having a central bore 339, fixedly co-locates about the shaft 218 in proper alignment to the shoe lace attachment hole 340. The drum 294 has a winding surface 342 preferably having a concave or like profile to ensure centralizing of the shoe lace winding to prevent unwanted wandering of the shoe lace and to prevent unwanted potential of lace jamming between the outer extremities of the drum 294 and the sidewalls of the upper housing 202 and the lower housing 204. Additionally, the tolerance fit of the drum 294 with the sidewalls of the upper housing 202 and the lower housing 204 is sufficiently close so that a shoe lace can not jammingly engage the spaces therebetween. Access hole set 344 allows access to opposing ends of the shoe lace attachment hole 340. A hole set 346 extends through an edge of the drum 294 to accommodate a pin 348 extending through a pin receptor hole 350 located near the end of the shaft 218. The drum 354 associated with the ratcheted drum 306 is constructed in a similar fashion.

Another such component which fixedly mounts along and about the shaft 218 is the one-piece ratcheted drum 306 which includes a ratchet wheel 352 and a drum 354. The drum 354 extends in mirror-like fashion with respect to the drum 294. The drum 354 has the same attributes accorded to drum 294 including hole sets 356 and 358 and a concave profile winding surface 360. A central bore 362 is central to the drum 354 and central to the ratchet wheel 352. A pin 364 driven through the hole set 358 in the drum 354 and through a pin receptor hole 366 in the shaft 218 near the end of the shaft 218 secures the ratcheted drum 306 to the shaft 218. A shoe lace attachment hole 368, similar to the shoe lace attachment hole 340, is located near the end of the shaft 218 in alignment with hole set 356. Although the winding surfaces 342 and 360 of the drums 294 and 354 show winding surfaces 342 and 360 having a concave profile, other suitable surfaces, such as, but not limited to, a cylindrical surface, can be incorporated into the drums 294 and 354.

Also positioned and mounted along and about the shaft 218 are the compression spring 296 and the return spring 302. One end of the compression spring 296 is in close communication with the drum 294. The opposing end of the compression spring 296 aligns over the spring locator 332 and against the cam disk 330 of the ratcheted cam disk 298 in close communication, thus urging the ratcheted cam disk 298 toward the ratcheted actuator spool 300 causing engagement of the ratchet teeth 329 of the ratcheted cam disk 298 with the ratchet teeth 316 of the ratcheted actuator spool 300. Such an engaged relationship takes place and is useful during the tightening of the shoe laces 26 and 28 where the actuator cord 54, pre-wound about the ratcheted actuator spool 300, is pulled, whereby the ratchet teeth 316 of the ratcheted actuator spool 300 positively engage the ratchet teeth 329 of the ratcheted cam disk 298 to cause counterclockwise rotation of the shaft 218 to windingly tighten the shoe laces 26 and 28 about the drum 294 and the drum 354 of the ratcheted drum 306 at opposing ends of the shaft 218.

The return spring mount 304, which secures to the lower housing 204, includes a spring anchor support plate 370 having a cylindrical spring anchor 372 with a slot 374 therein and a central bore 375. The return spring 302 includes an inwardly placed tab 376 which engages the slot 374. The main body of the return spring 302 aligns over and about the cylindrical spring anchor 372. The cylindrical spring anchor 372 and the mounted return spring 302 align together in the spring housing 318 of the ratcheted actuator spool 300. The outboard end of the return spring 302 includes geometry to connect to the spring housing 318 which also includes connective geometry (not shown). Such an engaged relationship takes place and is useful where the rotation of the shaft 218 is springingly countered to urge rotation of the shaft 218 in a direction opposing the rotational direction utilized for shoe lace tightening.

The release lever 244 includes a pawl 240 and an opposed cam actuator bar 242 extending from the main body of the release lever and having holes 378 and 380. The axle pin 234 engages holes 378 and 380 of the release lever 244 and extends through and outwardly from the holes 378 and 380 to engage notches 230 and 232 in the lower housing 204. The pawl 240 interfaces with the ratchet wheel 352 and the cam actuator bar 242 interfaces with the ratcheted cam disk 298 to influence the rotational positioning of the shaft 218. A positioning spring 382 aligns over and about the axle pin 234 and has a first end which engages the top side of the cam actuator bar 242 and a second end which engages the closest interior mounting fixture 250 or alignment pin 256 to keep the pawl 240 positioned to engage the ratchet wheel 352, as well as to return the cam actuator bar 242 after release of the shoe laces 26 and 28. The stationary relationship of the release lever 244 and the features incorporated therein to the shaft 218, the ratcheted actuator spool 300, the ratcheted drum 306, and other adjacent components is best viewed in FIG. 12 where the pawl 240 is engaged with the ratchet wheel 352 and where the cam actuator bar 242 is in close proximity to but not engaging the cam disk 330 of the ratcheted cam disk 298.

Mode of Operation

In the same manner as previously described, the shoe laces 26 and 28 pass from the integral body member or shoe upper 14 through the guide tubes 46 and 50 which connect to the mounting fixtures 280 and 282, respectively, and through the upper housing 202 to connect through hole set 344 and hole set 356 of the drum 294 and the drum 354 of the ratcheted drum 306 to the shoe lace attachment holes 340 and 368, respectively. The actuator cord 54 passes through the guide tube 58 which is attached to the mounting formation 278 and thence coils partially about the actuator spool drum 312 of the ratcheted actuator spool 300 where one end of the actuator cord 54 suitably attaches, such as by a knot or other suitable arrangement, to the holed actuator cord attachment flange 324. The opposing ends of the shaft 218 are supported in part by the journal box halves 214 and 216 of th lower housing 204 and in part by the corresponding journal box halves 274 and 276 of the upper housing 202.

Figure 15:
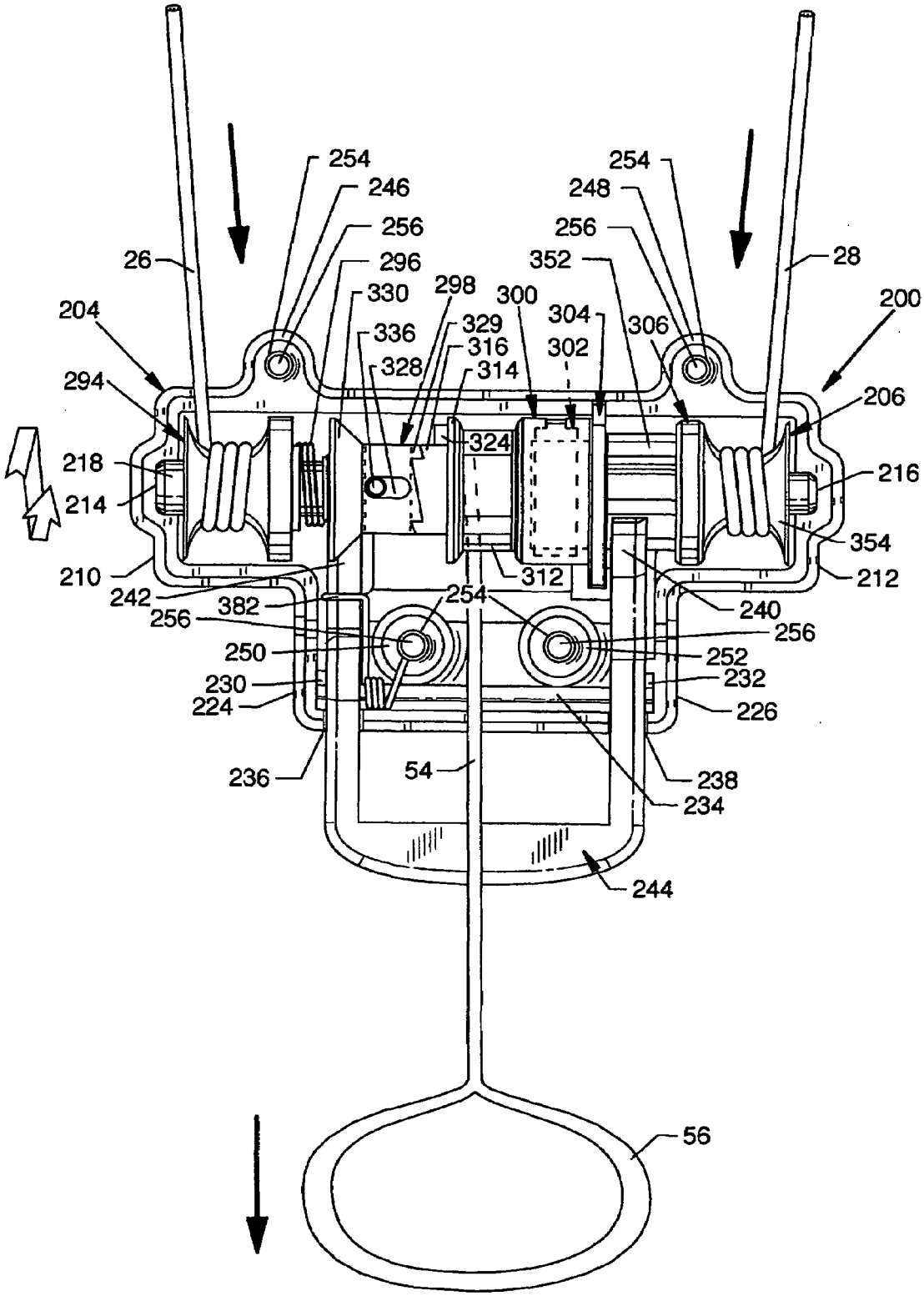
FIG. 15 is a top view of the tightening mechanism of the alternative embodiment just after the last stage of the tightening mode where the shoe laces have been tightened.
Figure 16:
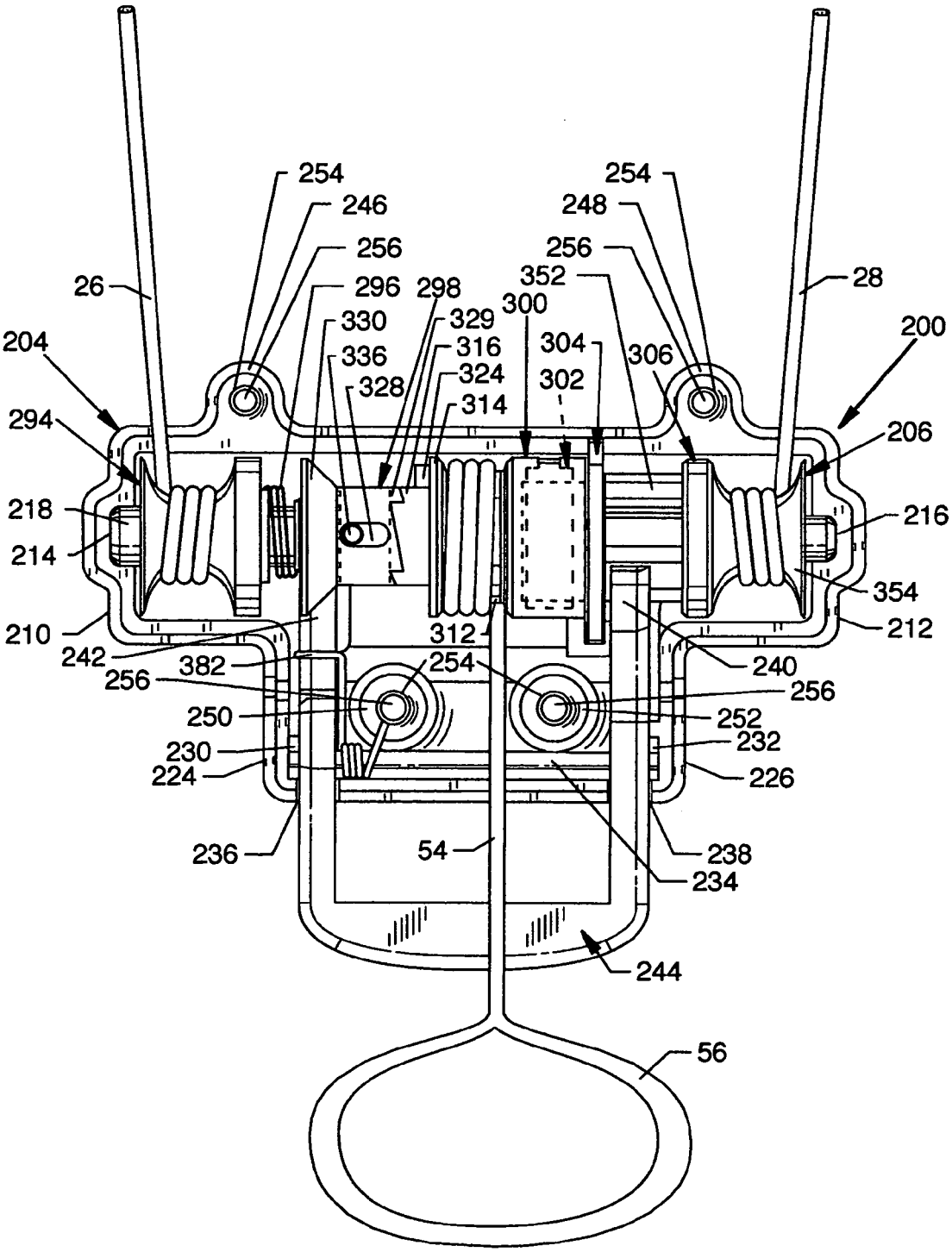
FIG. 16 is a top view of the tightening mechanism of the alternative embodiment in the tightened/recoiled mode; and, FIG. 17 is a top view of the tightening mechanism of the alternative embodiment in the release mode where the shoe laces are released from the tightening influence of the tightening mechanism.
Figure 17:
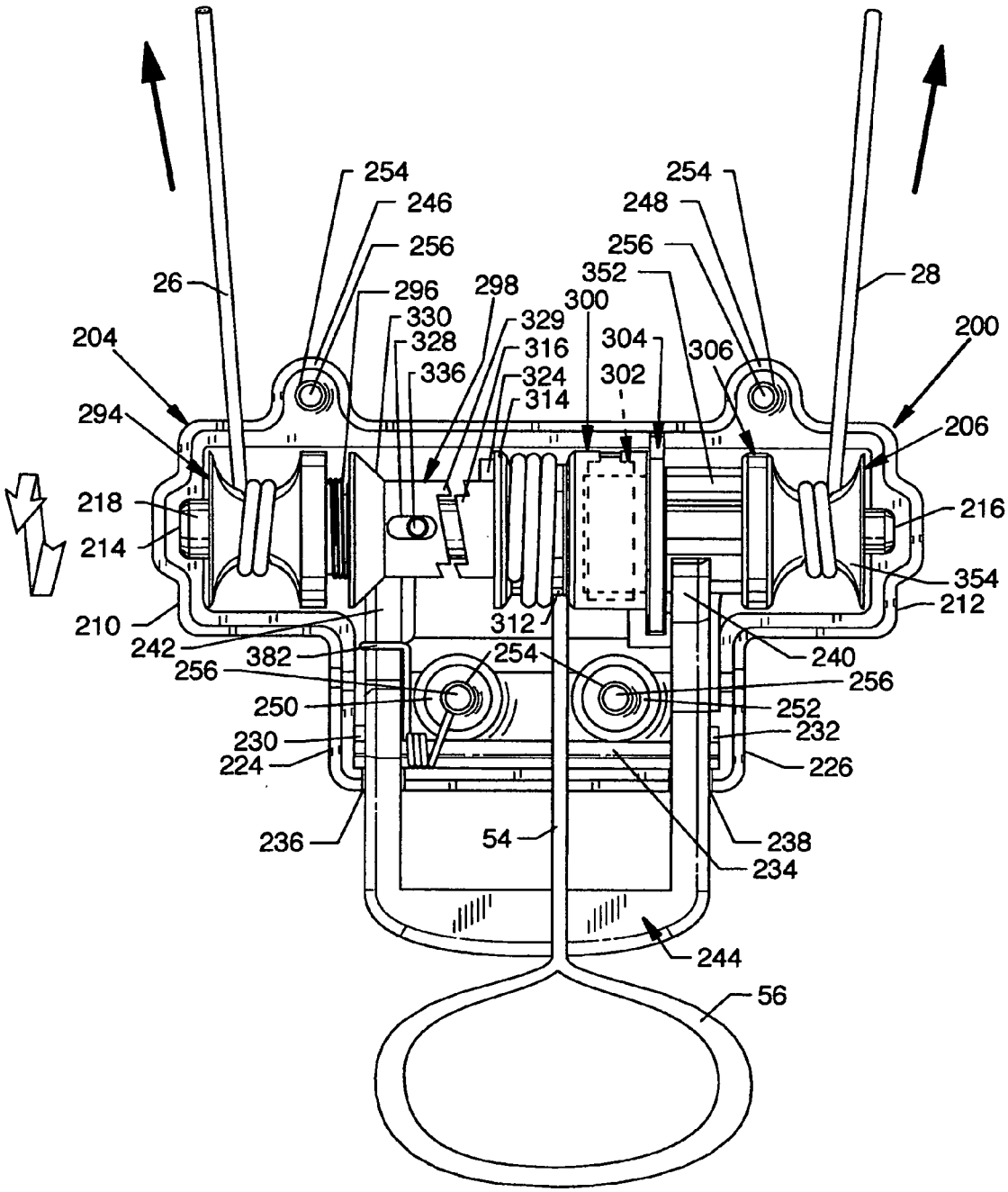

FIGS. 14, 15, 16 and 17 best illustrate the mode of op ration of the automated tightening shoe 10 alternatively incorporating the tightening mechanism 200 where reference is made to elements previously described in previous figures. Central to the operation of the invention is the tightening mechanism 200, where FIG. 14 is a top view of the tightening mechanism 200 in the inactive mode awaiting the tightening process, FIG. 15 is a top view of the tightening mechanism 200 just after the last stage of the tightening mode where the shoe laces 26 and 28 have been tightened, FIG. 16 is a top view of the tightening mechanism 200 in the tightened/recoiled mode, and FIG. 17 is a top view of the tightening mechanism 200 in the release mode where the shoe laces 26 and 28 are released from the tightening influence of the tightening mechanism 200. For purposes of brevity and clarity, the guide tubes 46, 50 and 58 are not necessarily shown. For uniformity of discussion and reference regarding rotation of the shaft 218, or components mounted thereupon or thereabout, direction of rotation is referenced to a view from the end of the shaft 218 adjacent to the end 210.

FIG. 14 is a top view of the tightening mechanism 200 in the inactive mode awaiting the tightening process. In the illustration, the tightening mechanism 200 is shown in the lower housing 204. The shoe laces 26 and 28 are loose in the lace eyelets 30, 32, 34, 36, 28 and 40, allowing the tongue 16 to be positioned toward the shoe laces 26 and 28, thereby allowing the user to insert his foot into the automated tightening shoe 10 incorporating the tightening mechanism 200. Although the tightening mechanism 200 is still in the inactive mode, forces are continually applied along the shaft 218 by the compression spring 296 to influence and cause the ratcheted cam disk 298 to be positioned toward the ratcheted actuator spool 300, whereby the ratchet teeth 329 of the ratcheted cam disk 298 are forced into intimate contact and engagement with the ratchet teeth 316 of the ratcheted actuator spool 300. Such engagement is beneficial to uni-directional actuation of the connected shaft 218 for tightening of the shoe laces 26 and 28 as caused by rotation of the ratcheted actuator spool 300 in a counterclockwise direction as viewed from the end of the shaft 218 adjacent to the end 210. Also influencing rotation of the shaft 218 is the release lever pawl 240 at one inwardly located end of the release lever 244 which successively and forcefully engages the ratchet teeth of the ratchet wheel 352 where such engagement maintains the position of the shaft 218 against reverse (clockwise) rotation when the shaft 218 is rotated in the counterclockwise direction. One end of the actuator cord 54 is attached, such as where a knot in one end engages the holed actuator cord attachment flange 324 and is coiled about the actuator spool drum 312 of the ratcheted actuator spool 300. The shoe laces 26 and 28 enter the drums 294 and 354 and the shoe lace attachment holes 340 and 368 in th shaft 218 and secure preferably therein by a knot which engages a preferably countersunk portion of the shoe lace attachment holes 340 and 368 to achieve a flush or near flush mount. Other such suitable methods of attachment of the shoe laces 26 and 28 to the shaft 218 can also be incorporated.

FIG. 15 shows the tightening mechanism 200 just after the last stage of the tightening mode where the shoe laces 26 and 28 have been tightened sufficiently in a direction indicated by adjacent dark arrows where the tightening mechanism 200 awaits the tightened/recoiled mode. In the illustration, the tightening mechanism 200 is shown in the lower housing 204. During the tightening mode, the actuator loop 56 is manually positioned to reposition and uncoil the actuator cord 54 outwardly, thereby forcing and causing the ratcheted actuator spool 300, the ratcheted cam disk 298, the shaft 218, the drum 294, and the ratcheted drum 306 to rotate in a counterclockwise direction, as shown, whereupon the shoe laces 26 and 28 tighteningly coil over and center about the drums 294 and 354 at opposite ends of the shaft 218, which tightens the shoe laces 26 and 28 of th automated tightening shoe 10. During such rotation, the ends of the locating pin 336 extending through the shaft 218 which engages the surfaces defining the elongated slot 328 in the ratcheted cam disk 298 transfer and impart rotational forces to urge the shaft 218 in counterclockwise rotation. During counterclockwise rotation of the shaft 218, the pawl 240 ratchetingly engages the ratchet teeth of the ratchet wheel 352 preventing meaningful rotational slippage in a reverse clockwise direction during tightening and during the static tightened mode. The static tightened mode incorporates the engagement of the pawl 240 with the ratchet wheel 352 to maintain tension on the shoe laces 26 and 28 during the static tightened mode.

During the tightening mode, a one-way clutch-like positive engagemental relationship is maintained in one rotational direction between the ratcheted actuator spool 300 and the ratcheted cam disk 298 during counterclockwise rotation. In this relationship, the return spring 302 is wound and tightened, thereby storing energy to be directed in an opposing and clockwise direction, thereby urging the ratcheted actuator spool 300 in a clockwise direction to foster clockwise rotation of the ratcheted actuator spool 300, when required. Force from the return spring 302 overcomes the minute and weak frictional engagement of the ratcheted actuator spool 300 and the ratcheted cam disk 298 offered in a clockwise direction. Accordingly, a slipping weak engagemental relationship is also maintained in an opposite rotational direction (clockwise) between the ratcheted actuator spool 300 and the ratcheted cam disk 298 during clockwise rotation of the ratcheted actuator spool 300. During rotation of the ratcheted actuator spool 300 in either direction, the tightened rotational state of the shaft 218 is maintained by engagement of the pawl 240 with the ratchet wheel 352. Such relationships, as described above, cause and allow the actuator cord 54 to be automatically retracted into the tightening mechanism 200 and stored as a coil about the actuator spool drum 312 of the ratcheted actuator spool 300, while still maintaining the shoe laces 26 and 28 in a tightened state. In the alternative, short actuations of the actuator cord 54 can be repeated to incrementally tighten the shoe laces 26 and 28 about the ratcheted actuator spool 300.

FIG. 16 shows th tightening mechanism 200 in the tightened/recoiled mode where the automated tightening shoe 10 has been secured to the foot of a user and ready for use. In the illustration, the tightening mechanism 200 is shown in the lower housing 204. In the illustration, the actuator cord 54 has been automatically recoiled and stored about the actuator spool drum 312 of the ratcheted actuator spool 300 by the recoiling action of the return spring 302.

FIG. 17 illustrates the tightening mechanism 200 in the release mode where th shoe laces 26 and 28 are released from the tightening influence of the tightening mechanism 200. In the illustration, the tightening mechanism 200 is shown in the lower housing 204. The release mode is accomplished by actuation of the end of the release lever 244 downwardly either manually or by using the to, portion or other portion of the opposite shoe or foot followed by or including simultaneous flexing in a forward and upward direction of the dorsal (upper) region of the foot contained in the subject automated tightening shoe 10. Such urging of the release lever 244 end downwardly causes the release lever 244 to pivot about the axle pin 234, thereby simultaneously affecting the relationship of the pawl 240 and the ratchet wheel 352 and the relationship of the cam actuator bar 242 to the ratcheted cam disk 298. The changing relationships of the above components cause freewheeling of the shaft 218 so that the shoe laces 26 and 28 may be loosened. During such actuation and event, the pawl 240 is removed from intimate contact with the teeth of the ratchet wheel 352, thereby allowing the shaft 218 and the ratcheted actuator spool 300 and other fixedly attached or slidingly attached components to freewheel. Simultaneously during such actuation and event, the cam actuator bar 242 contacts the cam disk 330, which is beveled, to urge the ratcheted cam disk 298 away from the ratcheted actuator spool 300 and toward the drum 294 to discontinue any relationship, ratcheted or otherwise, of the ratcheted cam disk 298 and the ratcheted actuator spool 300 to which the actuator cord 54 is secured, thereby leaving the ratcheted actuator spool 300 and attached actuator cord 54 rotationally untouched and unencumbered by any attachment thereto by the ratcheted cam disk 298; i.e., the winding means is totally disassociated by longitudinal sliding of the ratcheted cam disk 298 along the shaft 218 from engagement with the ratcheted actuator spool 300 to allow freewheeling of the shaft 218, the ratcheted cam disk 298 and the drum 294 and the ratchet drum 306 including the drum 354. During such actuation, the elongated slot 328 of the ratcheted cam disk 298 traverses the ends of the locating pin 336 extending from the shaft 218. Such action leaves the actuator cord 54 unaffected and coiled about the ratcheted actuator spool 300 ready for the next tightening event. As the user flexes the dorsal region of the foot forwardly and upwardly, the shoe laces 26 and 28 are urged upwardly and forwardly tensioning and causing the shoe laces 26 and 28 to rotate the shaft 218 in a clockwise direction to uncoil from the drum 294 and the ratchet drum 306 including the drum 354 at the ends of the shaft 218 and loosening the shoe laces 26 and 28 so that the user may remove his foot from the automated tightening shoe 10.

Various modifications can be made to the present invention without departing from the apparent scope thereof.

It is claimed:

1. An automated tightening shoe comprising:

a. a sole;

b. an integral shoe upper connected to the sole, the integral upper including a toe, a heel, a tongue, a gap above the tongue, a junction of the tongue to the integral shoe upper near a lower end of the gap, and a reinforced lacing pad aligned about the edge of the gap and aligned generally to the tongue, the reinforced lacing pad having a number of pairs of lace eyelets provided around the periphery of the gap;

c. a tightening mechanism in the heel;

d. a pair of opposed guide means, each of the opposed guide means extending from adjacent the reinforced lacing pad to the tightening mechanism;

e. lacing means for tightening the shoe at the gap, the lacing means extending through alternate lace eyelets in crisscross fashion over the tongue, and thence through the pair of opposed guide tubes to within the tightening mechanism in the heel whereat the shoe laces are operatively associated in a tightening or in a loosening direction with the tightening mechanism.

2. The automated tightening shoe of claim 1, wherein the lacing means are anchored to near the junction of the tongue to the integral shoe upper near the lower part of the gap.

3. The automated tightening show of claim 2, wherein the lacing means is anchored by a fixture.

4. The automated tightening shoe of claim 1, wherein the lacing means includes a pair of laces, each of the laces of the pair being anchored near the junction of the tongue to the integral shoe upper near the lower part of the gap, crisscrossing the tongue in an opposed fashion and extending through an opposite opposed single guide tube of the pair of opposed guide tubes.

5. The automated tightening shoe of claim 1, wherein the lacing means is a single lace with a midpoint of the single lace situated near the junction of the tongue to the integral shoe upper near the lower part of the gap and opposing portions of the single lace crisscrossing the tongue in an opposed fashion and extending through an opposite opposed guide tube of the pair of opposed guide tubes.

6. The automated tightening shoe of claim 5, wherein the single lace is anchored at the midpoint near the junction of the tongue to the integral shoe upper near the lower part of the gap.

7. The automated tightening shoe of claim 6, wherein the single lace is anchored by a loop.

8. The automated tightening shoe of claim 1, wherein the tightening mechanism includes a shaft located within a lower housing and an upper housing located in the heel.

9. The automated tightening shoe of claim 8, wherein the shaft is horizontally oriented.

10. The automated tightening shoe of claim 8, wherein the shaft is laterally oriented.

11. The automated tightening shoe of claim 10, wherein the tightening mechanism further includes a ratcheted actuator spool on the shaft, the ratcheted actuator spool including ratchet teeth.

12. The automated tightening shoe of claim 11, wherein the tightening mechanism has the ratcheted actuator spool slideably mounted and upon which a closely associated adjoining coupling collar with ratchet teeth is mounted.

13. The automated tightening shoe of claim 12, wherein the ratcheted actuator spool includes two disks, one of which is beveled and serves as a cam, which cam is utilized during release of tension of the lacing means.

14. The automated tightening shoe of claim 13, wherein the ratchet wheel has a coupling collar, which coupling collar also mounts upon the shaft and is incorporated with a pawl to tighten the lacing means.

15. The automated tightening shoe of claim 14, wherein the tightening mechanism further includes a tensioning spring and a return spring co-located between the ratchet wheel and the ratcheted actuator spool.

16. The automated tightening shoe of claim 15, wherein the tightening mechanism further includes a release lever, which release lever protrudes from the rear of the heel, and which release lever pivotally mounts to support panels extending from the upper and lower housings and includes a pawl which is engageable with the ratchet wheel and a cam actuator bar opposing the pawl.

17. The automated tightening shoe of claim 16, wherein the pawl successively engages the ratchet teeth of the ratchet wheel to prevent reverse movement.

18. The automated tightening shoe of claim 16, wherein the lacing means pass from the guide tubes to within the upper and lower housings of the tightening mechanism, and coil in the same direction about opposite ends of the shaft, and further wherein the actuator cord is coiled about and secured to the ratcheted actuator spool in a direction opposite to the direction in which the lacing means coil.

19. The automated tightening shoe of claim 18, wherein the actuator cord has an end extending out of a passageway in the heel and includes an actuator loop for grasping to move the actuator cord in the tightening direction.

20. The automated tightening shoe of claim 19, wherein when the actuator cord is pulled by the actuator loop, the shoe laces further coil about the shaft, thereby the shoe is tightened.

21. The automated tightening shoe of claim 19, wherein when the actuator cord is pulled by the actuator loop, the shoe laces further coil about a drum, thereby the shoe is tightened.

22. An automated shoe lace tightening mechanism, comprising:

a. a housing;

b. a shaft rotatably carried within the housing;

c. a ratcheted actuator spool slideably mounted upon the shaft, the ratcheted actuator spool including ratchet teeth;

d. a ratcheted coupling collar, closely adjoining the ratcheted actuator spool with ratchet teeth upon the shaft, the coupling collar fixedly attached to the shaft;

e. a ratchet wheel fixedly attached to the shaft; and, f. a pair of coiling means on the shaft for coiling laces so as to tighten a shoe.

23. The automated shoe lace tightening mechanism of claim 22, further comprising an actuator cord engaged with and coiled about the ratcheted actuator spool such that pulling the actuator cord to uncoil the actuator cord drives the ratcheted actuator spool to in turn drive the ratcheted coupling collar to in turn rotate the shaft to coil shoe laces in the pair of coiling means thereby tightening shoe laces.

24. The automated shoe lace tightening mechanism of claim 23, further comprising a return spring co-located between the ratchet wheel and the ratcheted actuator spool, the return spring fixed to the upper and lower housing on a first end and fixed to the ratcheted actuator spool on a second end, such that the ratcheted actuator spool disengages from the ratcheted coupling collar and rotationally recoils the actuator cord.

25. The automated shoe lace tightening mechanism of claim 24, further comprising a pawl engaging the ratchet wheel so as to limit rotation of the shaft during recoil of the actuator cord.

26. Th automated shoe lace tightening mechanism of claim 25, further comprising:

a. an actuator spool cam associated with the ratcheted actuator spool; and, b. a cam actuator;

wherein interaction of the cam actuator with the actuator spool cam forces disengagement of the ratcheted actuator spool from the ratcheted coupling collar to facilitate uncoiling of shoe laces.

27. The automated shoe lace tightening mechanism of claim 26, wherein the cam actuator and the pawl are simultaneously releasable to allow uncoiling of shoe laces.

28. The automated shoe lace tightening mechanism of claim 23, wherein the actuator cord protrudes from the upper and lower housings.

29. The automated shoe lace tightening mechanism of claim 28, wherein the actuator cord protruding from the upper and lower housings has a terminal loop.

30. The automated shoe lace tightening mechanism of claim 23, wherein the actuator cord coils opposite to the coiling of the shoe laces in the coiling means.

31. The automated shoe lace tightening mechanism of claim 22, further comprising a tensioning spring urging the ratcheted actuator spool to slide into engagement with the ratcheted coupling collar.

32. The automated shoe lace tightening mechanism of claim 22, further comprising a release lever carrying the cam actuator and the pawl.

33. The automated shoe lace tightening mechanism of claim 32, further comprising an axle pin carrying the release lever, the axle pin carried by the upper and lower housings.

34. The automated shoe lace tightening mechanism of claim 33, wherein the release lever protrudes from the upper and lower housings.

35. The automated shoe lace tightening mechanism of claim 22, wherein each of the coiling means includes a shoe lace attachment hole in the shaft.

36. The automated shoe lace tightening mechanism of claim 22, wherein the coiling means includes a drum.

37. The automated shoe lace tightening mechanism of claim 22, wherein the shaft includes an annular shoulder to limit sliding of the ratcheted actuator spool.

38. An automated shoe lace tightening mechanism, comprising:

a. an upper housing;

b. a lower housing joined to the upper housing;

c. a shaft rotatably carried within the upper and lower housings;

d. a ratcheted actuator spool slideably mounted upon the shaft, the ratcheted actuator spool including ratchet teeth;

e. a ratcheted cam disk, closely adjoining the ratcheted actuator spool with ratchet teeth upon the shaft, the ratcheted cam disk being rotationally fixed relative to the shaft but slidable upon the shaft;

f. a ratchet wheel fixedly attached to the shaft; and, g. a pair of coiling means on the shaft for coiling laces so as to tighten a shoe.

39. The automated shoe lace tightening mechanism of claim 38, further comprising an actuator cord engaged with and coiled about the ratcheted actuator spool such that pulling the actuator cord to uncoil the actuator cord drives the ratcheted actuator spool to in turn drive the ratcheted cam disk to in turn rotate the shaft to coil shoe laces in the pair of coiling means thereby tightening shoe laces.

40. The automated shoe lace tightening mechanism of claim 39, further comprising a return spring co-located between the ratchet wheel and the ratcheted actuator spool, the return spring fixedly connected to the upper and lower housing and fixedly connected to the ratcheted actuator spool on a second end, such that the ratcheted actuator spool disengages from the ratcheted cam disk and rotationally recoils the actuator cord.

41. The automated shoe lace tightening mechanism of claim 39, further comprising a pawl engaging the ratchet wheel so as to limit rotation of the shaft during recoil of the actuator cord.

42. The automated shoe lace tightening mechanism of claim 39, further comprising a cam actuator; and wherein interaction of the cam actuator with the ratcheted cam disk forces disengagement of the ratcheted actuator spool from the ratcheted cam disk to facilitate uncoiling of shoe laces.

43. The automated shoe lace tightening mechanism of claim 42, wherein the cam actuator and the pawl are simultaneously releasable to allow uncoiling of shoe laces.

44. The automated shoe lace tightening mechanism of claim 43, further comprising a release lever carrying the cam actuator and the pawl.

45. The automated shoe lace tightening mechanism of claim 44, further comprising an axle pin carrying the release lever, the axle pin carried by the upper and lower housings.

46. The automated shoe lace tightening mechanism of claim 45, wherein the release lever protrudes from the upper and lower housings.

47. The automated shoe lace tightening mechanism of claim 39, wherein the actuator cord protrudes from the upper and lower housings.

48. The automated shoe lace tightening mechanism of claim 47, wherein the actuator cord protruding from the upper and lower housings has a terminal loop.

49. The automated shoe lace tightening mechanism of claim 38, further comprising a tensioning spring urging the ratcheted actuator spool to slide into engagement with the ratcheted cam disk.

50. The automated shoe lace tightening mechanism of claim 38, wherein each of the coiling means includes a shoe lace attachment hole in the shaft.

51. The automated shoe lace tightening mechanism of claim 50, wherein the actuator cord coils opposite to the coiling of the shoe laces in the coiling means.

52. The automated shoe lace tightening mechanism of claim 50, wherein each of the shoe laces coil upon a drum carried upon the shaft.

53. An automated tightening shoe comprising:

a. a sole and an integral body member or shoe upper constructed of any common sport or athletic shoe material or materials connected to the sole;

b. the integral body member or shoe upper includes a toe, a heel, a tongue, a gap above the tongue;

c. a reinforced lacing pad aligned about the edge of the gap and aligned generally to the tongue, the reinforced lacing pad having a number of pairs of lace eyelets provided around the periphery of the gap;

d. the shoe includes a tightening mechanism in the heel with a pair of shoe laces, or alternatively a single length shoe lace, is provided for tightening the shoe at the gap, each shoe lace has one external end anchored preferably to the region of the shoe upper at or near the junction of the tongue and the lower part of the gap by an anchoring fixture which can be a loop or other suitable device; and, e. the shoe laces extend through alternate lace eyelets in crisscross fashion over the tongue, and then pass through guide tubes which extend from the tightening mechanism through the material at the side of the shoe upper to within the tightening mechanism in the heel whereby the shoe laces are operatively associated in a tightening or in a loosening direction with the tightening mechanism.

54. Th automated tightening shoe mechanism of claim 53, including an actuator cord which resides partly within a guide tube extending from the tightening mechanism through the fabric of the rear vertical portion of the heel and which has an actuator loop at one end. The actuator cord is movable in the guide tube in a tightening or in a loosening direction with the tightening mechanism.

55. The automated tightening shoe mechanism of claim 53, including a shaft located within a lower housing and an upper housing located in the heel upon which a ratcheted actuator spool including a plurality of ratchet teeth is slideably mounted and upon which a closely associated adjoining coupling collar with a plurality of ratchet teeth is mounted, the ratcheted actuator spool includes two disks, one of which is beveled and serves as a cam which is utilized during shoe lace tension release, a ratchet wheel having a coupling collar also mounts upon the shaft and is incorporated with a pawl to tighten the shoe laces, and a compression spring and a return spring co-locate between the ratchet wheel and the ratcheted actuator spool.

56. The shoe release lever of claim 53, which protrudes from the rear of the heel, pivotally mounts to support panels extending from the upper and lower housings and includes a pawl which is engageable with the ratchet wheel and a cam actuator bar opposing the pawl.

57. The shoe laces of claim 53, after entering the upper and lower housings of the tightening mechanism, are directed or coiled in the same direction about opposite ends of the shaft, and the actuator cord is coiled about and secured to the ratcheted actuator spool in a direction which is opposite to the direction in which the shoe laces are directed or coiled, the actuator cord has an end extending out of a passageway in the heel and, as previously mentioned, includes an actuator loop for grasping to move the actuator cord in the tightening direction, when the actuator cord is pulled by the actuator loop, the shoe laces further coil about the shaft or alternatively about a drum, thereby the shoe is tightened, and the pawl successively engages the ratchet teeth of the ratchet wheel to prevent reverse movement.

58. A method for automating shoe lace tightening comprising the steps of:

a. providing a shoe including:

(1) a sole;

(2) an integral shoe upper connected to the sole, the integral upper including a toe, a heel, a tongue, a gap above the tongue, a junction of the tongue to the integral shoe upper near a lower end of the gap, and a reinforced lacing pad aligned about the edge of the gap and aligned generally to the tongue, the reinforced lacing pad having a number of pairs of lace eyelets provided around the periphery of the gap;

(3) a tightening mechanism in the heel, the tightening mechanism including an actuator cord, the actuator cord protruding through the heel of the shoe;

(4) a pair of opposed guide tubes, each of the opposed guide tubes of the pair of opposed guide tubes extending from adjacent the reinforced lacing pad to the tightening mechanism;

(5) lacing means for tightening the shoe at the gap, the lacing means extending through alternate lace eyelets in crisscross fashion over the tongue, and thence through the pair of opposed guide tubes to within the tightening mechanism in the heel whereat the shoe laces are operatively associated in a tightening or in a loosening direction with the tightening mechanism; and, b. pulling the actuator cord to coil the laces within the tightening mechanism.

59. A method for tightening a shoe comprising the steps of:

a. providing a shoe including:

(1) a sole;

(2) an integral shoe upper connected to the sole, the integral upper including a toe, a heel, a tongue, a gap above the tongue, a junction of the tongue to the integral shoe upper near a lower end of the gap, and a reinforced lacing pad aligned about the edge of the gap and aligned generally to the tongue, the reinforced lacing pad having a number of pairs of lace eyelets provided around the periphery of the gap;

(3) a tightening mechanism in the heel, the tightening mechanism including an actuator cord, the actuator cord protruding through the heel of the shoe;

(4) a pair of opposed guide tubes, each of the opposed guide tubes of the pair of opposed guide tubes extending from adjacent the reinforced lacing pad to the tightening mechanism;

(5) lacing means for tightening the shoe at the gap, the lacing means extending through alternate lace eyelets in crisscross fashion over the tongue, and thence through the pair of opposed guide tubes to within the tightening mechanism in the heel whereat the shoe laces are operatively associated in a tightening or in a loosening direction with the tightening mechanism; and, b. pulling the actuator cord to coil the laces within the tightening mechanism.

60. A method of loosening a shoe having an automated tightening mechanism, comprising the steps of:

a. providing a shoe including:

(1) a sole;

(2) an integral shoe upper connected to the sole, the integral upper including a toe, a heel, a tongue, a gap above the tongue, a junction of the tongue to the integral shoe upper near a lower end of the gap, and a reinforced lacing pad aligned about the edge of the gap and aligned generally to the tongue, the reinforced lacing pad having a number of pairs of lace eyelets provided around the periphery of the gap;

(3) a tightening mechanism in the heel, the tightening mechanism including releasable coils of laces within the mechanism;

(4) a pair of opposed guide tubes, each of the opposed guide tubes of the pair of opposed guide tubes extending from adjacent the reinforced lacing pad to the tightening mechanism;

(5) lacing means for tightening the shoe at the gap, the lacing means extending through alternate lace eyelets in crisscross fashion over the tongue, and thence through the pair of opposed guide tubes to within the tightening mechanism in the heel whereat the shoe laces are operatively associated in a tightening or in a loosening direction with the tightening mechanism; and, b. releasing the coiled shoe laces within the tightening mechanism.

* * * * *